US010357067B2

(12) United States Patent
Yeomans et al.

(10) Patent No.: US 10,357,067 B2
(45) Date of Patent: Jul. 23, 2019

(54) ARTICLES OF SPORTS APPAREL WITH SUPPORT ELEMENTS

(71) Applicant: adidas AG, Herzogenaurach (DE)

(72) Inventors: Deborah Yeomans, Herzogenaurach (DE); Verena Melanie Botha, Herzogenaurach (DE); Andreas Metzger, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 284 days.

(21) Appl. No.: 15/267,446

(22) Filed: Sep. 16, 2016

(65) Prior Publication Data

US 2017/0079339 A1 Mar. 23, 2017

(30) Foreign Application Priority Data

Sep. 17, 2015 (DE) ..... 10 2015 217 841

(51) Int. Cl.
*A41D 7/00* (2006.01)
*A41D 13/00* (2006.01)
(Continued)

(52) U.S. Cl.
CPC ..... *A41D 13/0007* (2013.01); *A41D 7/00* (2013.01); *A41D 7/005* (2013.01); *A41D 13/0015* (2013.01); *A41D 13/02* (2013.01); *A41D 27/06* (2013.01); *A41D 31/02* (2013.01); *A41D 2300/22* (2013.01); *A41D 2400/24* (2013.01); *A41D 2400/38* (2013.01); *A41D 2500/50* (2013.01); *A41D 2600/10* (2013.01)

(58) Field of Classification Search
CPC .. A41D 13/0015; A41D 13/0007; A41D 7/00; A41D 7/005; A41D 13/02; A41D 27/06; A41D 31/02; A41C 3/0057; A41C 3/00; A41C 3/10; A41C 3/142
USPC ..... 2/69, 227, 228, 238, 115
See application file for complete search history.

(56) References Cited

U.S. PATENT DOCUMENTS 1,128,682 A 2/1915 Homewood
1,277,074 A 8/1918 Hitzeman
(Continued)

FOREIGN PATENT DOCUMENTS

DE 102004006485 8/2005
DE 202013003618 9/2013
(Continued)

OTHER PUBLICATIONS

"A Swimsuit Issue: Out of the Frying Pan", Author unknown, Sports Illustrated, Dec. 14, 1998, p. 34.
(Continued)

*Primary Examiner* — Gloria M Hale
(74) *Attorney, Agent, or Firm* — Kilpatrick Townsend & Stockton LLP

(57) ABSTRACT

Articles of sports apparel may include elongate support elements. Particular examples provided are swimsuits and other sports apparel such as sports apparel for rugby football. An Article of sports apparel may include at least one base portion adapted to be arranged proximate a lower back of a user when worn, and at least three elongate support elements. The at least three elongate support elements may be arranged at the base portion such as to extend outwardly from a region at least partially encompassing the lower back of the user when worn.

28 Claims, 7 Drawing Sheets

(51) Int. Cl.

| | |
|---|---|
| ***A41D 13/02*** | (2006.01) |
| ***A41D 27/06*** | (2006.01) |
| ***A41D 31/02*** | (2019.01) |

(56) References Cited

U.S. PATENT DOCUMENTS

| | | | |
|---|---|---|---|
| 1,535,481 | A | 4/1925 | Kjelgaard |
| 1,633,610 | A | 6/1927 | Schneider |
| 1,839,489 | A | 1/1932 | Meroussis |
| 2,550,327 | A | 4/1951 | Christensen |
| 3,015,829 | A | 1/1962 | Gronkowski |
| D202,976 | S | 11/1965 | O'Neill |
| 3,286,287 | A | 11/1966 | Martin |
| 3,786,526 | A | 1/1974 | Ausseil |
| 3,975,929 | A | 8/1976 | Fregeolle |
| 4,015,448 | A | 4/1977 | Knohl |
| 4,153,050 | A | 5/1979 | Bishop et al. |
| 4,176,665 | A | 12/1979 | Terpening |
| 4,180,065 | A | 12/1979 | Bowen |
| 4,311,135 | A | 1/1982 | Brueckner et al. |
| 4,371,989 | A | 2/1983 | Polsky |
| 4,488,317 | A | 12/1984 | Polsky |
| 4,502,301 | A | 3/1985 | Swallow et al. |
| 4,502,473 | A | 3/1985 | Harris et al. |
| 4,538,615 | A | 9/1985 | Pundyk |
| 4,570,625 | A | 2/1986 | Harris |
| 4,654,894 | A | 4/1987 | Kudo |
| 4,670,913 | A | 6/1987 | Morell et al. |
| 4,698,847 | A | 10/1987 | Yoshihara |
| 4,785,480 | A | 11/1988 | Polsky |
| 4,862,523 | A | 9/1989 | Lipov |
| 4,946,453 | A | 8/1990 | Monson |
| 5,046,194 | A | 9/1991 | Alaniz et al. |
| 5,052,053 | A | 10/1991 | Peart et al. |
| 5,055,075 | A | 10/1991 | Waller, Jr. |
| 5,109,546 | A | 5/1992 | Dicker |
| 5,139,475 | A | 8/1992 | Robicsek |
| 5,161,257 | A | 11/1992 | Arensdorf et al. |
| 5,176,600 | A | 1/1993 | Wilkinson |
| 5,186,701 | A | 2/1993 | Wilkinson |
| 5,201,074 | A | 4/1993 | Dicker |
| D339,902 | S | 10/1993 | Doherty |
| 5,282,277 | A | 2/1994 | Onozawa |
| 5,306,222 | A | 4/1994 | Wilkinson |
| 5,338,235 | A | 8/1994 | Lee |
| 5,359,732 | A | 11/1994 | Waldman |
| 5,367,708 | A | 11/1994 | Fujimoto |
| 5,431,030 | A | 7/1995 | Ishizaki et al. |
| 5,465,428 | A | 11/1995 | Earl |
| 5,546,955 | A | 8/1996 | Wilk |
| 5,570,472 | A | 11/1996 | Dicker |
| 5,603,232 | A | 2/1997 | Throneburg |
| 5,606,745 | A | 3/1997 | Gray |
| 5,659,895 | A | 8/1997 | Ford, Jr. |
| 5,671,482 | A | 9/1997 | Alvera |
| 5,700,231 | A | 12/1997 | Wilkinson |
| 5,707,266 | A | 1/1998 | Arena |
| 5,720,042 | A | 2/1998 | Wilkinson |
| 5,720,472 | A | 2/1998 | Ohgitani |
| 5,737,773 | A | 4/1998 | Dicker et al. |
| 5,745,917 | A | 5/1998 | Dicker et al. |
| 5,768,703 | A | 6/1998 | Machado et al. |
| 5,787,509 | A | 8/1998 | Alvera |
| 5,819,322 | A | 10/1998 | Dicker |
| 5,826,761 | A | 10/1998 | Basaj |
| 5,839,122 | A | 11/1998 | Dicker |
| 5,867,827 | A | 2/1999 | Wilkinson |
| 5,875,491 | A | 3/1999 | Wilkinson |
| 5,894,970 | A | 4/1999 | Belkin |
| 5,898,948 | A | 5/1999 | Kelly et al. |
| D412,772 | S | 8/1999 | Fujii et al. |
| 5,937,442 | A | 8/1999 | Yamaguchi et al. |
| D416,124 | S | 11/1999 | Davies et al. |
| 5,978,966 | A | 11/1999 | Dicker |
| 5,994,612 | A | 11/1999 | Watkins |
| 5,996,120 | A | 12/1999 | Balit |
| 6,047,405 | A | 4/2000 | Wilkinson |
| 6,047,406 | A | 4/2000 | Dicker |
| D427,750 | S | 7/2000 | Fujii |
| 6,098,198 | A | 8/2000 | Jacobs et al. |
| 6,112,502 | A | 9/2000 | Frederick et al. |
| 6,176,816 | B1 | 1/2001 | Dicker |
| 6,186,970 | B1 | 2/2001 | Fujii et al. |
| 6,195,801 | B1 | 3/2001 | Meyers |
| 6,231,488 | B1 | 5/2001 | Dicker et al. |
| 6,258,014 | B1 | 7/2001 | Karecki |
| 6,311,334 | B1 | 11/2001 | Reinhardt et al. |
| 6,314,584 | B1 | 11/2001 | Errera |
| 6,332,825 | B1 * | 12/2001 | Henricksen ..... A41C 3/0057 450/1 |
| 6,368,256 | B1 | 4/2002 | Rumbaugh |
| D456,588 | S | 5/2002 | Fairhurst et al. |
| D460,242 | S | 7/2002 | Fairhurst et al. |
| D461,033 | S | 8/2002 | Fairhurst et al. |
| 6,430,752 | B1 | 8/2002 | Bay |
| 6,430,753 | B2 | 8/2002 | Duran |
| 6,438,755 | B1 | 8/2002 | MacDonald et al. |
| 6,446,264 | B2 | 9/2002 | Fairhurst et al. |
| 6,546,560 | B2 | 4/2003 | Fusco et al. |
| D485,048 | S | 1/2004 | Janes |
| 6,684,410 | B2 | 2/2004 | Robinett et al. |
| D504,202 | S | 4/2005 | Coutant |
| 6,874,337 | B2 | 4/2005 | Uno et al. |
| D512,203 | S | 12/2005 | Ota et al. |
| D513,830 | S | 1/2006 | Ota et al. |
| D514,774 | S | 2/2006 | Africa et al. |
| D515,282 | S | 2/2006 | Africa et al. |
| D518,276 | S | 4/2006 | Fairhurst et al. |
| D520,715 | S | 5/2006 | Ota et al. |
| 7,074,204 | B2 | 7/2006 | Fujii et al. |
| D541,008 | S | 4/2007 | Fairhurst et al. |
| D541,009 | S | 4/2007 | Ota et al. |
| D548,928 | S | 8/2007 | Wong |
| D584,484 | S | 1/2009 | Rance et al. |
| D586,081 | S | 2/2009 | Rance et al. |
| D586,082 | S | 2/2009 | Rance et al. |
| 7,526,929 | B2 | 5/2009 | Takamoto et al. |
| D593,728 | S | 6/2009 | Rance et al. |
| D596,378 | S | 7/2009 | Borchardt |
| D601,778 | S | 10/2009 | Rance et al. |
| D602,677 | S | 10/2009 | Cowan |
| D606,283 | S | 12/2009 | Rance et al. |
| 7,631,367 | B2 | 12/2009 | Caillibotte et al. |
| D608,981 | S | 2/2010 | Cowan |
| 7,730,552 | B2 | 6/2010 | Ota et al. |
| 8,286,262 | B2 | 10/2012 | Rance et al. |
| 8,356,363 | B2 | 1/2013 | Caillibotte et al. |
| 8,407,814 | B2 | 4/2013 | Caillibotte et al. |
| D681,916 | S | 5/2013 | Tanaka et al. |
| 8,533,864 | B1 * | 9/2013 | Kostrzewski ..... A41D 13/0015 2/69 |
| 8,578,514 | B2 | 11/2013 | Caillibotte et al. |
| D698,518 | S | 2/2014 | Tanaka et al. |
| D702,918 | S | 4/2014 | Radford et al. |
| 9,179,713 | B2 | 11/2015 | Hays et al. |
| D750,348 | S | 3/2016 | Hammer et al. |
| D760,997 | S | 7/2016 | Gallo et al. |
| D768,357 | S | 10/2016 | White et al. |
| D769,579 | S | 10/2016 | Griffin |
| 9,516,905 | B2 * | 12/2016 | Pagnon ..... A41C 3/10 |
| 9,596,893 | B2 | 3/2017 | Fukuyo et al. |
| D785,292 | S | 5/2017 | Kandarian et al. |
| D789,034 | S | 6/2017 | Musciacchio |
| D789,036 | S | 6/2017 | Luong |
| D793,666 | S | 8/2017 | Sun |
| D795,530 | S | 8/2017 | Musciacchio |
| D797,403 | S | 9/2017 | Moore |
| D798,530 | S | 10/2017 | Cook |
| D803,521 | S | 11/2017 | Musciacchio |
| D806,358 | S | 1/2018 | Flockton et al. |
| D806,360 | S | 1/2018 | Musciacchio |
| D809,245 | S | 2/2018 | Yeomans et al. |
| D811,694 | S | 3/2018 | Griffin |
| 2001/0029224 | A1 | 10/2001 | Karecki |

(56) References Cited

U.S. PATENT DOCUMENTS

| | | | | |
|---|---|---|---|---|
| 2003/0028952 | A1 | 2/2003 | Fujii et al. | |
| 2003/0140391 | A1 | 7/2003 | Richards et al. | |
| 2003/0208829 | A1 | 11/2003 | Ragot et al. | |
| 2004/0016043 | A1 | 1/2004 | Uno et al. | |
| 2004/0078865 | A1 | 4/2004 | Culhane | |
| 2004/0107479 | A1 | 6/2004 | Dicker et al. | |
| 2004/0111781 | A1 | 6/2004 | Miyake et al. | |
| 2004/0255358 | A1 | 12/2004 | Ota et al. | |
| 2005/0166298 | A1 | 8/2005 | Pieroranzio | |
| 2005/0193461 | A1 | 9/2005 | Caillibotte et al. | |
| 2005/0223753 | A1 | 10/2005 | Nordstrom et al. | |
| 2007/0006356 | A1 | 1/2007 | Shiue | |
| 2008/0141431 | A1 | 6/2008 | Rance et al. | |
| 2008/0256675 | A1 | 10/2008 | Di Lorenzo | |
| 2009/0038047 | A1 | 2/2009 | Di Lorenzo | |
| 2009/0113596 | A1 | 5/2009 | Young | |
| 2010/0043114 | A1 | 2/2010 | Caillibotte et al. | |
| 2011/0237995 | A1 | 9/2011 | Ota et al. | |
| 2012/0144549 | A1 | 6/2012 | Caillibotte et al. | |
| 2012/0145290 | A1 | 6/2012 | Fronabarger et al. | |
| 2012/0151653 | A1 | 6/2012 | Caillibotte et al. | |
| 2014/0154949 | A1* | 6/2014 | Pagnon | A41C 3/00 450/57 |
| 2014/0338089 | A1 | 11/2014 | Mas-Bertrand et al. | |
| 2015/0107000 | A1 | 4/2015 | Tanaka et al. | |
| 2016/0044971 | A1* | 2/2016 | Randall | A41C 3/142 450/39 |

FOREIGN PATENT DOCUMENTS

| | | |
|---|---|---|
| EP | 1110464 | 6/2001 |
| EP | 1563748 | 8/2005 |
| EP | 1935265 | 6/2008 |
| EP | 2589307 | 5/2013 |
| GB | 2501396 | 10/2013 |
| JP | 2002-212814 | 7/2002 |
| KR | 1020130012745 | 2/2013 |
| WO | 2005102083 | 11/2005 |
| WO | 2016027068 | 2/2016 |

OTHER PUBLICATIONS

"adidas Equipment Bodysuit: Press Information.", adidas International B.V., Jun. 25, 1998.
"adidas International B.V.,", Advertisement: Men's Apparel, 1999.
"Slippery When Wet: Teflon Suit Takes the Drag Out of Swimming", Aqua Magazine, Feb. 1999, p. 14.
"Swim in Your adidas", Citv Sports Magazine., Nov. 1998.
"The Equipment Fullbody Suit", Adidas America, Available web site: http://adidas_america/publications/scoops/swim/swim.htm, Accessed on: Oct. 27, 1998.
"The influence of proprioception ?", adidas International, B.V. (Feb. 14, 2000) adidas Media Release:, Feb. 14, 2000.
Author Unknown , "Title Unknown", Dec. 1998.
Binole , "Swimmers Hope to Go Faster with adidas Suit", The Business Journal, Nov. 20, 1998.
Binole , "This swimsuit Won't Make SI's Cover", Sports Business Journal., Nov. 30, 1998.
Collcutt et al., "All-Over Costume Aims to Put Speed and Style in the Swim", Times of London, Jul. 7, 1998.
Office Action, German Patent Application No. 102015217841.2 , Aug. 18, 2016, 5 pages.
Dolbow , "The Score: The Look of Swim to Come?", Sportstyle, Oct. 1998, p. 7.
Feitelberg , "Sport Report: adidas Has Swimwear Covered", Women's Wear Daily, vol. 176, No. 72, p. 10., Oct. 15, 1998.
Kraemer et al., "Influence of a Compression Garment on Repetitive Power Output Production Before and After Different Types of Muscle Fatigue", Sports Med., Training and Rehab., vol. 8, No. 2, 1998, pp. 163-184.
Lord , "Putting the Squeeze on in the Fast Lane", Times of London, Jul. 15, 1998.
McMorris , "Personal Trainer Great Gear: Does it Work?", Sports Illustrated for Women, 1999, pp. 118-119.
Mendel, "Dressed to Compress", Athletic Management, Feb./Mar. 1994, pp. 40, 42, and 44.
Parrack , "ASA National Championships and Commonwealth Trials", Swimming Times, Aug. 1998, pp. 5 and 9.
Sharp et al., "Influence of Body Hair Removal on Physiological Responses During Breaststroke Swimming", Medicine and Science in Sports and Exercise, vol. 21, No. 5:, Oct. 1989, pp. 576-580.
Smith , "The Man with the Golden Feet", Sports Illustrated, Nov. 22, 1999, 7 pages endinq on page No. 114.
Stromgren Supports, Inc., "Online history and product information", Available web site: http:www.stromgren.com/history.htm and http://www.stromqren.com/study.htm, Accessed on May 31, 2000., 1999-2000.
Torres , "PulseFitness: Does it Work? Well Suited", Rodale's Fitness Swimmer, May-Jun. 1999.
Weede , "Power Suits", Sportstyle, Dec. 1998.
Weiss , "Can Lycra® Power Improve Your Performance?", About.com [Online], Available web site: http://bicycling.about.com/sports/bicycling/library/weekly/aa080697.htm?iam=ask&terms=lycra, Accessed on: Feb. 23, 2000., Aug. 6, 1997.
Williams et al., "Swimming Performance and Hydrodynamic Characteristics of Harbor Seals Phoca Vitulina", Physiological Zoology. vol. 58, No. 5, Sep.-Oct. 1985, pp. 576-589.
"adizero XVI Launch Event", adidas swim, available at https://www.youtube.com/watch?v=JFt79tKoKGA at least as early as Nov. 19, 2015, 1 page.
European Application No. 16188490.3, Extended European Search Report dated Jan. 24, 2017, 8 pages.
"adidas Equipment Fullbody Suit: adidas Revolutionizes Swimming", adidas International, B.V., adidas Media Announcement: Photo Opportunity, available at least as early as Sep. 16, 2015.
"The Most Innovative adidas Products Based on the Athletes Needs Engineered for Performance information on Equipment Bodysuit.", adidas International, B.V., adidas Equipment, available at least as early as Sep. 16, 2015.
"Lycra@ Power Only by DuPont", DuPont (U.K.) Limited, available at least as early as Sep. 16, 2015.
"Quick Swim Facts", adidas International, B.V., adidas Media Announcement, available at least as early as Sep. 16, 2015.
"Technology Behind the Equipment Fullbodv Suit", adidas International, B.V., adidas Media Announcement, available at least as early as Sep. 16, 2015.
Chinese Application No. 201610828583.6, Office Action dated Mar. 16, 2018, 7 pages (No English translation available. A summary of the Office Action is provided with the Transmittal Letter submitted herewith).

* cited by examiner

ARTICLES OF SPORTS APPAREL WITH SUPPORT ELEMENTS

CROSS REFERENCE TO RELATED APPLICATION

This application is related to and claims priority benefits from German Patent Application No. DE 10 2015 217 841.2, filed on Sep. 17, 2015, entitled Articles of sports apparel with support elements ("the '841.2 application"). The '841.2 application is hereby incorporated herein in its entirety by this reference.

FIELD OF THE INVENTION

This invention relates to articles of sports apparel which may comprise elongate support elements. Particular examples provided are swimsuits and other sports apparel such as sports apparel for rugby football.

BACKGROUND

Articles of sports apparel usually are adapted to provide certain functionalities to the user, e.g. to protect the user from cold and moisture or to protect the user from abrasion or injuries. Sports apparel may also contribute to increase the performance of the user.

For example, EP 1 110 464 A2 discloses a close-fitting garment, especially a swimsuit, with panels of elastic stretch fabric joined at seams and shaped to conform with muscle groups of the body, in particular in the abdominal region and at the gluteal region. The swimsuit may incorporate elastic stretch fabric and fit tightly to the body for muscular support and the disposition of muscles over the body may be taken into account.

Furthermore, EP 1 935 265 A2 describes garments, for example swimsuits or other sports garments, in which a plurality of panels are laminated on the outer surface of a base layer of stretchable elasticated fabric. This may offer improved performance e.g. for competitive swimmers through a reduction in surface drag, a reduction in form drag and/or improved stability in the water.

However, the known articles of sports apparel have several drawbacks and may not be optimized for high performance sports applications. Therefore, there is need for improved articles of sports apparel, and it is an object of the present invention to provide such improved articles of sports apparel.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, an article of sports apparel comprises: at least one base portion adapted to be arranged proximate a lower back of a user when worn; at least two elongate support elements; wherein the at least two elongate support elements are attached to the at least one base portion such as to extend outwardly from a region at least partially encompassing the lower back of the user when worn; and wherein at least one of the at least two elongate support elements is arranged to cross over a spine of the user when worn.

In some embodiments, at least one of the at least two elongate support elements is arranged to form an angle with the spine in a range from 30° to 80°. In certain embodiments, at least one of the at least two elongate support elements is arranged to form an angle with the spine in a range from 50° to 71°.

In certain embodiments, the region is between a sacrum of the user and an upper end of a next-to-lowest lumbar vertebra of the user.

At least one of the at least two elongate support elements, in some embodiments, comprises a layer on at least one of an inside and an outside of the at least one base portion.

In some embodiments, at least one of the at least two elongate support elements is at least partly arranged at an inner and/or an outer surface of the at least one base portion at a seam of the at least one base portion.

In certain embodiments, at least one of the at least two elongate support elements comprises a thickness between 0.3 mm and 0.8 mm.

At least one of the at least two elongate support elements, in some embodiments, comprises a thermoplastic elastomer. In certain embodiments, at least one of the at least two elongate support elements comprises a polyurethane. In some embodiments, at least one of the at least two elongate support elements comprises a fabric.

In some embodiments, at least one of the at least two elongate support elements is attached to the at least one base portion by a discontinuous adhesive.

In certain embodiments, at least one of the at least two elongate support elements has a higher elastic modulus than the at least one base portion.

An elastic modulus of at least one of the at least two elongate support elements, in some embodiments, is lower in a direction along the at least one of the at least two elongate support elements compared to a direction orthogonal to the at least one of the at least two elongate support elements.

In certain embodiments, at least one of the at least two elongate support elements extends at least partly around a lateral torso region of the article of sports apparel. In some embodiments, at least two of the at least two elongate support elements intersect each other in a breast region of the article of sports apparel.

In some embodiments, at least one of the at least two elongate support elements extends at least partly around a lateral pelvis region of the article of sports apparel; and at least one of the at least two elongate support elements extends at least partly around a lateral thorax region of the article of sports apparel. In certain embodiments, at least one of the at least two elongate support elements extends at least partly around a shoulder region of the article of sports apparel.

At least one of the at least two elongate support elements, in some embodiments, circumscribes a leg region of the article of sports apparel. In certain embodiments, at least one of the at least two elongate support elements extends in at least one of a front region and a back region of a thigh region of the article of sports apparel.

In certain embodiments, at least one of the at least two elongate support elements extends in a groin region of the article of sports apparel.

The article of sports apparel, in some embodiments, further comprises a profile element arranged on the at least one base portion in the region at least partially encompassing the lower back of the user when worn.

In some embodiments, the at least one base portion comprises at least one artificial hollow fiber.

According to certain embodiments of the present invention, a method for manufacturing an article of sports apparel comprises: providing at least one base portion; providing at least one elongate support element; and pressing the at least one elongate support element on the at least one base portion at a temperature in a range of 100° C. and 180° C.

In some embodiments, the method further comprises applying a pressure of 2.8 bar to 4.1 bar.

In certain embodiments, the pressing occurs for a duration of 20 seconds to 30 seconds.

In some embodiments, the at least one elongate support element comprises at least two layers.

The at least one elongate support element, in some embodiments, comprises a low activation temperature adhesive activatable at a temperature in a range from 80° C. to 150° C.

According to certain embodiments of the present invention, an article of sports apparel comprises: at least one base portion adapted to be arranged proximate a lower back of a user when worn, wherein the at least one base portion comprises an inner surface and an outer surface; a plurality of elongate support elements that are disposed on at least one of the inner surface and the outer surface; and wherein at least two of the plurality of elongate support elements (i) cross one another in a region at least partially encompassing the lower back of the user when worn and (ii) extend outwardly from the region at least partially encompassing the lower back of the user when worn.

BRIEF DESCRIPTION OF THE DRAWINGS

In the following detailed description, embodiments of the invention are described referring to the following figures.

BRIEF DESCRIPTION

Figure 1:
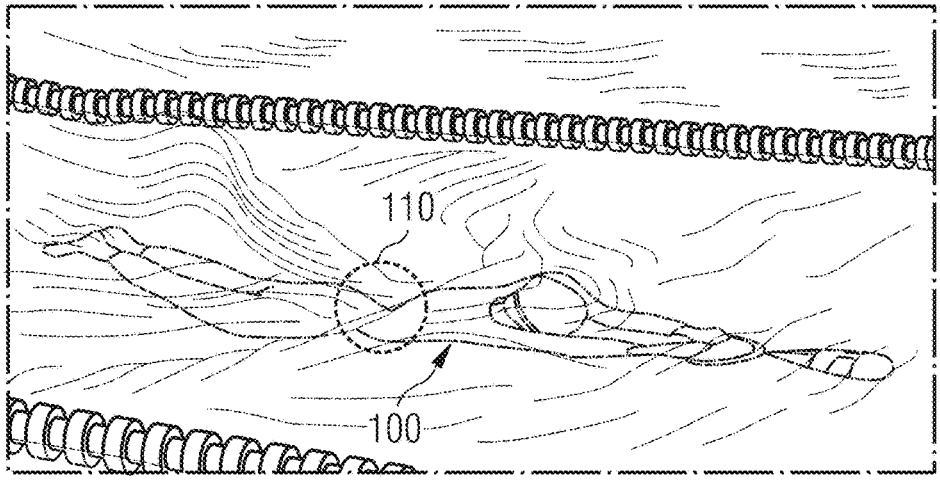
FIG. 1 is a perspective view of an article of sports apparel, according to certain embodiments of the present invention.

The above object is at least partly solved by an article of sports apparel that may comprise at least one base portion adapted to be arranged proximate a lower back of a user when worn. The article of sports apparel may further comprise at least three elongate support elements. The at least three elongate support elements may be arranged at the base portion such as to extend outwardly from a region at least partially encompassing the lower back of the user when worn.

It has turned out that the lower back, and in particular the spine in the lower back, is a sensitive part of the body in many sports. By providing a base portion at the lower back and three elongate support elements which are arranged at the base portion such as to extend outwardly from the region at least partially encompassing the lower back of the user when worn, this region may be supported not only along a line of a muscle but rather in various directions, such that the region may be supported irrespective of the precise movement of the user, and in particular also rotational movements of the spine may be balanced.

In addition, a stabilization of the spine provided by the three elongate support elements extending outwardly from the region at least partially encompassing the lower back of the user when worn may support the uniform distribution of the weight acting on an athlete and thus provide relief to the spine as a whole. In particular, by providing the elongate support element as an elastic element, this may lead to a more balanced force distribution and thus contribute to an increased performance of an athlete. As an example, the movements of a swimmer during a stroke cycle may be smoother owing to a more balanced force distribution by the three elongate support elements balancing the forces along three directions.

The elongate support elements may, for example, be arranged at least partly at an inner side (e.g. facing the body of the user) or an outer side of the at least one base portion or within, e.g. between various layers, of the at least one base portion. The elongate support elements may, for example, also be arranged at least partly adjacent to the at least one base portion. The elongate support elements may be attached or connected to the at least one base portion, e.g. using a seam, using an adhesive etc. The elongate support elements may be directly connected to the at least one base portion, e.g. by pressing or hot-pressing. In certain embodiments, the elongate support elements may be indirectly connected to the at least one base portion, e.g. at least one further element may be arranged in between an elongate support element and a base portion.

In some examples, at least one of the elongate support elements may be adapted to form at least one crossing over the spine. Such a crossing may provide a force-fit of the article of sports apparel across the spine, such that forces may be distributed evenly over the muscles around the spine. Such a force-fit over the spine may in particular be important for athletic sports, in which the targeted support of the spine may be essential, since the athlete has to keep a permanent body tension in the region of the spine. In particular, the crossing may be arranged in the lower back. Notably, for swimmers, the region of the lower back is typically immersed significantly more deeply into the water than, e.g., the torso, such that body tension is particularly important in this region in order to keep a good position in the water. In some examples, a crossing may be provided that may form an X-shape centered on the spine, wherein four elongate support elements may extend from the region above the spine (the four "arms" of the "X"). However, for example, in some embodiments, a Y-shape crossing is used, e.g. having three elongate support elements.

In addition, an angle between at least one of the elongate support elements and the spine may be in the range from 30° to 80°, in some embodiments, from 45° to 75°, particularly from 50° to 71°. The inventors have found that particularly large forces may arise in these angle ranges across the spine in many sports, e.g. swimming or rugby. The presence of a crossing over the spine formed by elongate support elements with an angle in this range may thus provide a particularly increased stability of the body with requiring only a minimum amount of added material. For example, in case of an X-shaped crossing, at least one elongate support element extending upwards may form an angle from 56° to 71°, and at least one elongate support element extending downwards may form an angle between 45° and 60°.

In some examples, the region at least partially encompassing the lower back of the user when worn may be located between a lower end of the sacrum and an upper end of the next to lowest lumbar vertebra of the user, for example between the sacrum and the next to lowest lumbar vertebra, or between the sacrum and the lowest lumbar vertebra. This region is particularly sensitive and a controlled stabilization of arbitrary movements by at least three support elements may provide the basis for relieving the spine. Thus, the long-term stability of this region, e.g. during swimming, may significantly be improved, and various back injuries such as lumbago, sciatica, herniated disks or chronic backaches may be avoided.

In some examples, at least one of the three elongate support elements may be adapted to form at least one crossing over the spine between a lower end of the sacrum and an upper end of the next to lowest lumbar vertebra, particularly between the sacrum and the next to lowest lumbar vertebra, or between the sacrum and the lowest lumbar vertebra.

In some examples, the elongate support elements may be at least partially arranged on an inner and/or an outer surface of the at least one base portion. Such a layer-like arrangement may allow the elongate support elements to be optimized for providing force feedback and stability, whereas the at least one base portion may be optimized separately, e.g. for providing a good wearing comfort, breathability, and/or reduced friction.

In some examples, at least one of the elongate support elements may be at least partly arranged at a seam (inner and/or outer surface of the seam) of the at least one base portion. For example, at least one based element may be attached to each other by at least one seam, e.g. seams made by stitching, welding, for example ultrasonic butt welding, etc. Placing at least one of the elongate support elements on an inner and/or outer surface at such a seam may contribute to a uniform distribution of the forces over the body despite the interruption of the force chain in the at least one base portion by the seam. Furthermore, the elongate support elements placed on a seam may provide the additional benefit of protecting against tearing and/or abrasion of the seam and/or water intake. It may also help to smoothen a seam such that e.g. surface drag of a swimsuit may be reduced. In some examples all seams, or a majority of seams, e.g. more than 50% or more than 75% or more than 90% or more than 95% of the seams, may be covered by at least one elongate support element.

In some examples, at least one of the elongate support elements may comprise a thickness between 0.3 mm and 0.8 mm, in some embodiments, between 0.4 mm and 0.7 mm, particularly in some embodiments, 0.6 mm. In other examples, a thickness of approximately 0.1 mm may be used. Due to a construction of such small thicknesses, the support elements may be lightweight, while at the same time providing sufficient support of the body. For example, for swimsuits, small thicknesses may particularly be suitable for avoiding turbulences on the surface of the swimsuit, which may be a source of surface drag.

In some examples, at least one of the elongate support elements may comprise a polymer, in some embodiments, a thermoplastic elastomer, and, in some embodiments, a polyurethane, e.g. a thermoplastic polyurethane (TPU). These materials have turned out to be particularly suitable since they may provide a low profile and thus lightweight support elements, which at the same time provide good stability and support. For example, for swimming applications, TPU may also serve to avoid water intake and to reduce surface drag compared to other materials. Furthermore, such materials may increase the performance of athletes, e.g. swimmers, since a density of the mentioned polymers may be low, e.g. lower by a factor of more than 50, more than 100 or even about 1000 compared to a density of water.

In some examples, at least one of the elongate support elements may comprise a fabric. The fabric may be employed to adapt the mechanical properties. Hence, based on a configuration using a fabric, which may be implemented with diverse properties, a more flexible way to distribute the forces over the body may be provided. In particular, at least one elongate support element may comprise a fabric and a polymer, e.g. natural and/or synthetic rubber, in which case the different regions of the elongate support element may independently be optimized as needed.

In addition, at least one elongate support element may be attached to the at least one base portion by a discontinuous adhesive, in particular a web-shaped adhesive. The presence of a discontinuous adhesive may ensure that the permeability of the article of sports apparel is not significantly compromised by the presence of an adhesive. Air and/or humidity may penetrate through the article of sports apparel at least in part via discontinuities of the adhesive, e.g. via the openings within the adhesive provided in a web shape. The breathability of the article of sports apparel may thus be improved.

In some examples, at least one elongate support element may have a higher elastic modulus than the at least one base portion. The elongate support elements may thus selectively increase the elastic modulus of the article of sports apparel along specific lines and, in particular, the at least three elongate support elements may thus increase the elastic modulus not only along a single force line but may span a plane of increased elastic modulus.

In some examples, at least one of the elongate support elements may have a lower elastic modulus in a direction along the at least one elongate support element compared to a direction orthogonal to the at least one elongate support element. Thus, the different support requirements along different directions of the body may be taken into account by a single support element. For example, an elongate support element may be arranged along a typical direction of motion of the user and its longitudinal elastic modulus may be optimized for that purpose. At the same time, for example, the elastic modulus in an orthogonal direction of the elongate support element may be higher such that the elongation of the sports apparel around, e.g. a torso, may be minimized and a tight fit may be provided. In other examples, an elastic modulus of at least one elongate support element may be anisotropic along other directions.

At least one of the elongate support elements may extend at least partly around a lateral torso region of the article of sports apparel. This may allow an improved stabilization of the user's body in the region of the lower back and controlled stabilization may be provided over a large area. For example, for swimsuits, this has turned out to particularly improve the stability of the body in the water.

In some examples, at least one of the elongate support elements may extend at least partly around a lateral pelvis region and/or a lateral thorax region and/or a shoulder region of the article of sports apparel. For example, elongate support elements extending from the region at least partially encompassing the lower back of the user when worn to the lateral pelvis region may provide particular stability around the entire lower back of the user. Elongate support elements extending from the at least partially encompassing the lower back of the user when worn to a lateral thorax region and/or the shoulder region may provide a force fit over essentially the entire back of the user such that forces may be distributed more evenly. For example, in rugby, elongate support elements extending to the shoulder region may reduce the forces acting on the front and back shoulder joints e.g. during the scrum in a rugby match.

At least two of the elongate support elements may intersect each other in a front region of the article of sports apparel, in particular in a breast region of the article of sports apparel. Such a placement of elongate support elements extending from the lower back all the way to intersect at a breast region has turned out to lead to an improved performance of a user in athletic sports, e.g. swimming. This may be attributed to the force-fit around the torso of the user and a more regular distribution of the forces within a stroke cycle of a swimmer.

In some examples, at least one of the elongate support elements may circumscribe a leg region of the article of sports apparel. For example, a thigh region, e.g. an upper and/or a lower thigh region, may be circumscribed. A tight fit and/or a correct placement of the article of sports apparel on the body of the user may thus be ensured.

At least one of the elongate support elements may extend in a front region and/or a back region of a thigh region of the article of sports apparel. Such elongate support elements may support leg movements, e.g. for running or swimming. For example for breaststroke swimmers, whose leg movements are particularly crucial for optimizing performance may benefit from such elongate support elements.

In some examples, the elongate support elements may extend in a groin region of the article of sports apparel.

The article of sports apparel may comprise a profile element, which may be arranged at the at least one base portion above the spine in the lower back of the user. In particular for swimsuits, providing a profile element in the lower back, e.g. at least partially above the spine, may avoid the stall of a laminar boundary layer in this region, which would increase drag. This region is typically susceptible to such a stall since the lower back is usually immersed into the water more deeply than the upper back and/or the buttocks, such that the boundary layer along the swimsuit needs to follow a rather long trajectory. The profile element may be adapted to locally create a turbulent layer bridging the region in the lower back, such that a continuous boundary layer may extend across this region despite the long trajectory. Hence, drag may be reduced. For example, the profile element may comprise at least one rib extending horizontally across the region. It is noted that the risk of stalling is increased if the body position of the user in the water gets worse. The combination of providing at least three elongate support elements (improving the body position in the water) and a profile element has therefore turned out to be particularly effective in reducing drag.

In some examples, the at least one base portion may comprise at least one artificial hollow fiber. In particular for swimsuits, selectively providing artificial hollow fibers in the base portion with a limited degree of water intake may allow controlling the buoyance and/or the buoyance distribution provided by the at least one base portion. A hollow fiber is understood as a fiber, which encloses at least one cavity. Artificial fibers are fibers made from artificial material, as opposed to natural fibers which may be made from natural materials such as cotton.

According to another aspect, an article of sports apparel may be provided which comprises at least one base portion adapted to be arranged proximate a lower back of a user when worn. The article of sports apparel may further comprise at least two elongate support elements. The at least two elongate support elements may be arranged at the at least one base portion such as to extend outwardly from the region at least partially encompassing the lower back of the user when worn in a non-axially-symmetric manner with respect to the spine.

According to another aspect, an article of sports apparel may be provided, e.g. a swimsuit, which comprises at least one artificial hollow fiber.

Artificial hollow fibers may have a lower water intake than conventional fibers which may, e.g. in a swimsuit, lead to the improved buoyance as mentioned. Thus, less parts of the athlete are under water which may reduce the drag resistance. A fabric, in particular a fabric comprising hollow fibers, used in the invention may be particularly water repellent. Therefore, such fabric may not get wet, thus providing good buoyance and also minimizing the drag.

Artificial hollow fibers may also have a lower mass density than conventional fibers which may, e.g. in a swimsuit, lead to the improved buoyance as mentioned. Thus, less parts of the athlete are under water, which may reduce the drag resistance. At the same time, the use of artificial hollow fibers does not significantly limit embodiments for optimizing the swimsuit in the same manner as with conventional fibers, e.g., as regards dying.

In some embodiments, the at least one artificial hollow fiber may have an essentially tubular shape, with a pseudo-oval (e.g. oval, elliptical, etc.) or pseudo-circular cross section.

In some embodiments, the at least one artificial hollow fiber has an outer diameter of 1 μm to 50 μm, 10 μm to 30

μm, or 15 μm to 20 μm, for example of about 17 μm. The at least one artificial hollow fiber may be provided as a single filament having a linear mass density from 1 dtex to 10 dtex, 1 dtex to 7 dtex, or 1 dtext to 3 dtex, for example 2 dtex. The inventors have found that such hollow fibers and filaments (a single artificial hollow fiber with a very long, theoretically infinite, length) provide a good compromise between improved buoyance and stability as well as flexibility, e.g. of a swimsuit, so that it fits closely and tightly to the body of the user. In this context and also in the following, the term "essentially" refers to typical product tolerances in this technical field.

According to further embodiments, the at least one artificial hollow fiber may include at least one internal cavity, which may extend along the at least one artificial hollow fiber and may have an essentially circular cross-section, e.g. with a diameter of 1 μm to 20 μm, or 5 μm to 10 μm, for example about 7 μm. Again, such values have been found to maximize the increase of the buoyance without endangering the flexibility and stability of a swimsuit.

In some embodiments, the article of sports apparel, e.g. a swimsuit, may comprise a fabric including a plurality of artificial hollow fibers, wherein the fabric may also include non-hollow fibers. The fabric may be a woven fabric comprising a first and a second yarn, wherein the first yarn and the second yarn comprise different amounts of artificial hollow fibers. In addition, the first and/or the second yarn may comprise an elastic material such as elastane for example. Such a fabric may combine the beneficial properties of an improved buoyance with elastic properties, which are needed to provide a close-fitting swimsuit.

In some embodiments, an article of sports apparel, e.g. swimsuit, comprises a first portion, wherein the first portion comprises a first percentage of artificial hollow fibers and a second portion, wherein the second portion comprises a second percentage of artificial hollow fibers wherein the first and the second percentage are different. Such embodiments may be beneficial for the correct positioning and drag distribution, for example if provided as a swimsuit, also when devoid of any elongate support element. First and second portions may for example be provided as and/or arranged as base portions as described herein.

Different portions may be differently customized, depending on which part of the body is to be covered by a respective portion and/or depending on the buoyance required for each part of the body. For example, a portion of the swimsuit extending around an elbow needs more stretch flexibility than a portion extending along a forearm, and/or some parts of the body may require more buoyance than others do, as already explained. The different percentages of artificial hollow fibers provide the ability to adapt the buoyance and also other properties such as water repellency or flexibility for example as they are needed for different parts of the whole body of the user.

In some embodiments, the swimsuit may comprise a portion devoid of any hollow fibers. This portion may be positioned to cover the back of the user of the swimsuit, in particular it may cover lumbar 5 and lumbar 4 vertebrae. For example, the portion may be adapted as a base portion as described herein.

In addition, this portion may comprise at least one profile element, in particular a rough fabric. Such fabric, contrary to a water repellent fabric, may help to avoid turbulent flows on the surface of the back of the user, which may be a reason for reduced performance.

According to further embodiments, the present invention is directed to a method comprising a step of including at least one artificial hollow fiber in the article of sports apparel.

Further embodiments of the present invention may relate to a method for manufacturing an article of sports apparel, e.g. an article of sports apparel as described herein. The method may comprise the steps of providing at least one base element and providing at least one elongate support element. The at least one elongate support element may be pressed on the at least one base portion at a temperature in the range of 100° C. and 180° C., and may further be in the range of 120° C. and 140° C. or 160° C. to 180° C. These temperature ranges may provide an efficient method for durably attaching the elongate support element to the base portion. At the same time, the low temperatures applied during pressing allow avoiding damage to the base portion of the article of sports apparel. The elongate support element may be elastic. In other examples, also support elements in general, e.g. non-elongate support elements, may be pressed on a base element to provide an article of sports apparel as explained above.

In some examples, a pressure of 2 bar to 6 bar, and further a pressure of 2.8 bar to 4.1 bar may be applied during pressing.

For example, the step of pressing may be carried out for a duration of 15 seconds to 40 seconds, and further a duration of 20 seconds to 30 seconds.

The at least one support element may be provided having at least two layers. For example, a first layer of the support element may be optimized for adhesion to the base portion, whereas a second layer may be adapted to provide the desired support.

In some examples, the support element comprises a low activation temperature adhesive, particularly an adhesive activatable at a temperature in the range from 80° C. to 150° C., or from 100° C. to 140° C., or from 120° C. to 130° C. This low temperature range may allow safely attaching the support element also to base portions comprising sensitive materials, e.g. comprising fabrics, e.g. including nylon, elastane, polyester, cotton and/or any blend thereof.

It is noted that in some examples, an article of sports apparel may generally be provided which comprises at least one base portion, and at least one elongate support element arranged at the base portion. For example, two elongate support elements may extend outwardly from the region at least partially encompassing the lower back of the user when worn.

It is noted that the term "comprise" as used herein, also encompasses the term "consists of". Moreover, the terms "one or more" or "at least one" encompass any number, e.g. 1, 2, 3, 4, 5, . . . , as well as the terms "two or more", "three or more", etc., and "multitude of", and the terms "one or more of" and "at least one of" also encompass the term "all of". Finally, the terms "at least in part" or "at least partially" or "at least partly" as used herein, also encompass the notion of "fully".

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention will be described in the following mainly with particular reference to swimming and rugby. However, the concept of the present invention may identically or similarly be applied to articles of sports apparel for other sports, e.g. track and field, American football, soccer, cycling, weightlifting, etc.

Moreover, for brevity only a few embodiments may be described in the following. The skilled person will recognize that the specific features described with reference to these embodiments may be modified and combined differently and that certain aspects of the specific embodiments may also be omitted. Moreover, it is noted that the aspects described in the subsequent detailed description may be combined with aspects described in the above summary section.

FIG. 1 shows a swimmer 100 gliding from the left to the right through the water. The region 110 that at least partially encompasses the lower back of the swimmer, in particular between the end of the sacrum and the next to lowest lumber vertebra, generally tends to be immersed into the water more deeply than the upper body of the swimmer, in particular the torso, the arms and the head. The longer the trajectory of the boundary layer through this region is, the higher the risk that the boundary layer of water along the swimsuit stalls. The inventors have found that stabilizing the region 110 by three or more elongate support elements may improve the body position in the water such that the risk that the boundary layer of water on the body surface (or that of the swimsuit) may stall is significantly reduced.

In some embodiments, the elongate support elements are arranged to extend outwardly from a region at least partially encompassing the lower back of the user when worn in a non-axially-symmetric manner with respect the spine. In certain embodiments, the elongate support elements are arranged to extend outwardly from a region at least partially encompassing the lower back of the user when worn in an axially-symmetric manner with respect the spine.

Figure 2A:
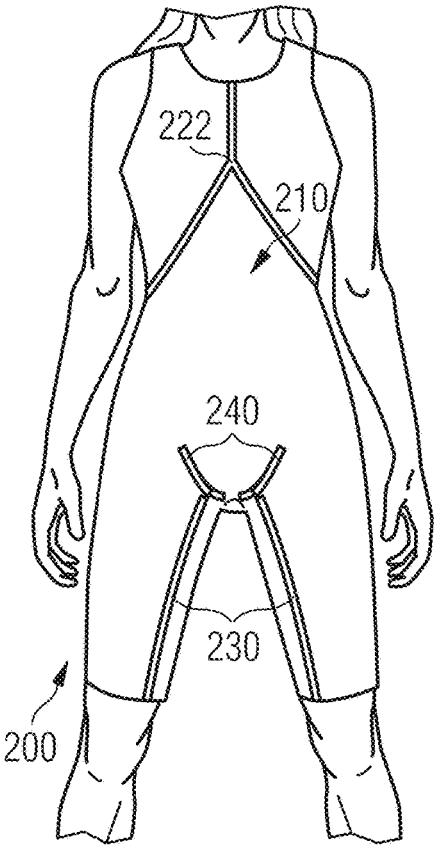
FIG. 2A is a front view of an article of sports apparel, according to certain embodiments of the present invention.
Figure 2B:
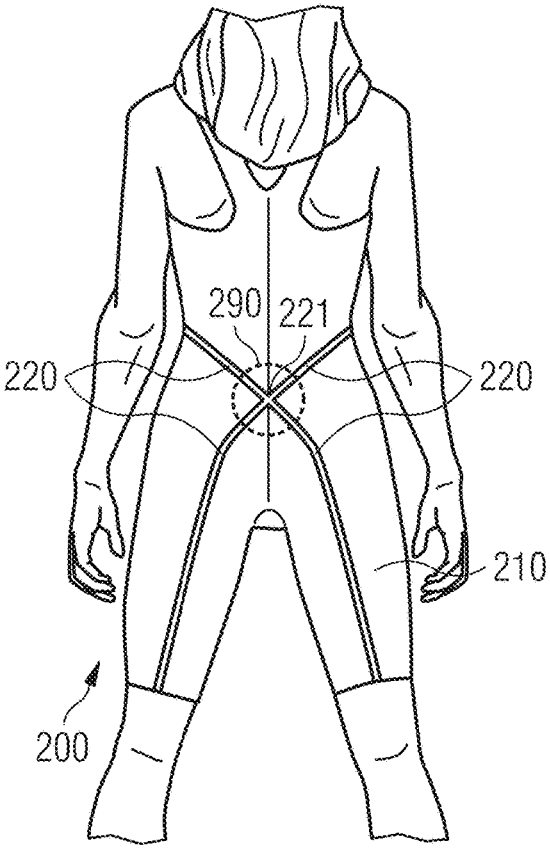
FIG. 2B is a rear view of the article of sports apparel of FIG. 2A.

FIGS. 2A (front view) and 2B (rear view) show embodiments for an article of sports apparel 200, in particular a swimsuit, which may be provided for women, in particular for freestyle swimming. The swimsuit 200 may comprise at least one base portion 210. The at least one base portion 210 may be adapted to be arranged proximate a lower back of a user when worn, as in the example shown in FIGS. 2A and 2B. In particular, the at least one base portion 210 may be arranged around thigh regions and a torso region of the user. In other examples, no base portion 210 may be provided in the thigh regions, e.g. the article of sports apparel may then "end" at a pelvis and/or cleat region of the user. Additionally or alternatively, in some examples, at least one base portion 210 may be arranged in shoulder and/or arm regions of the user. The swimsuit 200 comprises a front side as shown in FIG. 2A and a rear side as shown in FIG. 2B.

In some embodiments, the swimsuit 200 may comprise at least one elongate support element 220, 230, 240, which may be arranged at the at least one base portion 210. A first set of at least one elongate support element 220 may extend outwardly from a region 290 that at least partially encompasses the lower back of the user when worn, e.g. a first set of four elements 220, as in the example shown in FIGS. 2A-B. For example, the elongate support elements 220 may form a crossing 221, e.g. a single X-shaped crossing, in the region 290, as shown in FIG. 2. It is noted that in practical implementations the single X-shaped crossing of four elongate support elements (i.e. the four "arms" of the "X") may be formed by a single continuously applied coating, such that in essence only a single element is present. In addition, in practical implementations, the single X-shaped crossing may be formed by two bands/tapes etc. which cross over the spine, e.g. on top of each other. Nevertheless, even in such cases four "elongate support elements" are distinguished geometrically (namely the four "arms" of the X-shaped coating, the four "arms" formed by the two bands/tapes etc.) which extend outwardly from the region 290.

Region 290 (indicated by a dotted line in FIG. 2B) may be adapted to be arranged, at least partially, in an area located between the sacrum and the next to lowest lumbar vertebra, and/or the upper and/or lower end of said sacrum and/or next to lowest lumbar vertebra of a lower back of a user when worn. In case no specific ends of items are specified, the term "between" two items is intended to refer to a region approximately between the centers of each of the items. In particular, two of the first set of four elongate support elements 220 may extend upwards from the region 290, with an acute angle to the spine, around a lateral thorax region, e.g. around a lower lateral thorax region, or a lateral region in between the pelvis and the lowest ribs. In other examples, they may extend around a lateral pelvis region. The two elongate support elements 220 may extend diagonally upwards in a front region of the swimsuit 200, e.g. along a lower rim of the thorax, e.g. towards the sternum. The two elongate support elements 220 may intersect each other in a front torso region, in particular in a chest region, e.g. above the sternum, such that an intersection 222 may be formed, there. Above the intersection 222, a further elongate support element may extend upwards vertically to an upper torso region of the swimsuit 200, e.g. until an upper rim of the article of swimsuit 200 is reached.

Moreover, two of the mentioned first set of four elongate support elements 220 may extend downwards from the region 290, with an acute angle to the spine. They may extend across a pelvis and/or left and/or right buttocks regions and they may also extend along left and right thigh regions, respectively, of the rear side of the swimsuit 200, e.g. until they reach a lower rim of the swimsuit 200. In particular, each elongate support element 220 may comprise a bending in the pelvis region or in the left/right buttocks region towards the direction of the spine (making the angle to the spine more acute). The elongate support elements 220 may extend approximately vertically in the thigh regions, e.g. approximately parallel to the femur.

Furthermore, the swimsuit 200 may comprise a second set of at least one elongate support elements 230, e.g. a set of two as in the example of FIG. 2, which may extend vertically across left and right medial front thigh regions of the swimsuit 200, respectively. They may extend approximately parallel to the femur. In other examples, at least one elongate support element of the second set may, additionally or alternatively, for example extend in front thigh regions and/or lateral thigh regions.

The swimsuit 200 may moreover comprise a third set of at least one elongate support elements 240, e.g. a set of two as in the example of FIG. 2. These elongate support elements 240 may extend from a lower groin region upwards to the left and right, respectively, along the medial thigh and/or an upper groin region of the swimsuit 200.

In the example of FIG. 2, all elongate support elements 220, 230, 240 are arranged on the outside of the swimsuit 200. However, in other examples, at least one of the elongate support elements 220, 230, 240 may also be placed on the inside of the swimsuit 200 or additional elongate support elements may be provided on the inside of the swimsuit 200. For example, some of or all of the elongate support elements 220, 230, 240 could be duplicated on an inner side of the swimsuit 200. Some or all of the elongate support elements 220, 230, 240 could be arranged inside and/or outside at a seam of the swimsuit 200.

Generally, in all examples described herein, the elongate support elements could be placed on an outer side and/or an inner side, and some or all of the elongate support elements could be present on both an outer side and an inner side of the respective article of sports apparel, as needed. Moreover, some or all of the elongate support elements could generally be arranged at an inner and/or an outer surface at a seam of the respective article of sports apparel. For example, at least one elongate support element placed on an outer side may comprise polyurethane, e.g. a polyurethane tape, whereas at least one elongate support element placed at an inner side may comprise a fabric, e.g. a fabric tape.

It is noted that the swimsuit may in some examples comprise only a single base portion. However, in other examples two or more base portions may be provided which are connected to each other e.g. by a seam. In such examples, the seams may be placed such that these are at least partially covered by the elongate support elements 220, 230, 240.

The at least one base portion 210 may comprise a fabric or a textile material, for example a knitted fabric, such as a warp-knitted fabric. In other examples, also woven fabric may for example be used. The at least one base portion may be elastic. For example, a stretching of more than 25%, more than 50% or more than 75% may be repeated without causing a permanent wearing out. For example, a base material may provide an elasticity that leads to an elastic elongation of 50% to 90% or 60% to 80% when loaded with a weight of 1.5 kg over a width of 150 cm.

For example, a first base material comprising 60% to 90%, 70% to 85% (e.g. 77%) polyamide and 40% to 10%, 30% to 15% (e.g. 23%) elastane may be used. For example, a material comprising a density in a range of 160 $g/m^2$ to 200 $g/m^2$, e.g. 180 $g/m^2$ be used. The first material may in particular be used as a base material for base portions of sports apparel embodied as a swimsuit.

As another example, a second base material comprising 50% to 80%, 55% to 70% (e.g. 65%) polyamide and 50% to 20%, 45% to 30% (e.g. 35%) elastane may be used. For example, a material comprising a density in a range of 265 $g/m^2$ to 305 $g/m^2$, e.g. 285 $g/m^2$ may be used. The second base material may in particular be used as a base material for base portions of sports apparel for athletic sports in which the athlete is not immersed into water, such as rugby or cycling.

Also, the polyamide may comprise a proportion of hollow polyamide fibers in different proportions. In some embodiments, 100% of the polyamide fibers used in the base material are hollow fibers.

In some examples, the at least one base portion may comprise the same material. In other examples, at least two base portions are provided which comprise different materials. For example, a first base portion may comprise at least one artificial hollow fiber, whereas a second base portion may not comprise any artificial hollow fiber. In certain embodiments, a first and a second base portion comprise artificial hollow fibers, wherein the first base portion comprises a different ratio by weight of artificial hollow fibers than the second base portion.

In some examples, the at least one elongate support element may comprise the same material and/or the same mechanical properties. In some embodiments, there are at least two elongate support elements that comprise different materials and/or different mechanical properties. Moreover, the elongate support elements of first, second, and/or third sets, e.g. as explained with reference to FIG. 2, may comprise different materials and/or different mechanical properties.

Generally, for the elongate support elements the same material may be used as for the at least one base portion. However, providing the elongate support elements with a different material may provide improved design options. For example, a polymer material, such as a thermoplastic elastomer, particularly a polyurethane may be used.

For example, a single or several layers of polymer material may be used. For example, an elastic polyurethane layer on top of a polyurethane adhesive layer may be used. For example, a polyurethane film may be used, e.g. such as the film which is available under the trade name TL644 from the company Bemis. The mentioned polymer materials may be the sole material of an elongate support elements. Particularly for swimsuit embodiments, elongate support elements comprising polyurethane, e.g. using the material TL644, may be provided. Alternatively, at least one of the polymer materials may be combined with each other and/or with further materials, e.g., with a fabric. For example, a polymer material may be provided on a fabric layer. The latter may in particular be the case for embodiments for which the user is not intended to be immersed into water, e.g. rugby, weightlifting, cycling, football, etc.

For example, a material of an elongate support element (or the elongate support element itself) having a thickness of 100 μm and a width of 1 inch may stretch by 40% when loaded with a force of 6 N to 12 N, 8 N to 10N or approximately 9 N.

For example, an elongate support element may have a thickness of 10 μm to 1 mm, or 50 μm to 500 μm or 80 μm to 200 μm, or approximately 100 μm. For example, an elongate support element may comprise an adhesive layer, which comprises 10% to 60%, 20% to 55% or about 50% of the thickness of the elongate support element. For example, the elongate support elements may be provided with a width of 1 mm to 5 cm, 3 mm to 4 cm, such as approximately 2 cm or 3 cm. For swimsuit embodiments, in particular lower values, e.g. 2 cm, may be used, whereas for applications in which the body of the user is not intended to be immersed in water, e.g. rugby, in particular slightly higher values, e.g. 3 cm may be used.

The mentioned materials and geometries may generally be used for any of the examples of sports apparel as described herein.

Figure 3A:
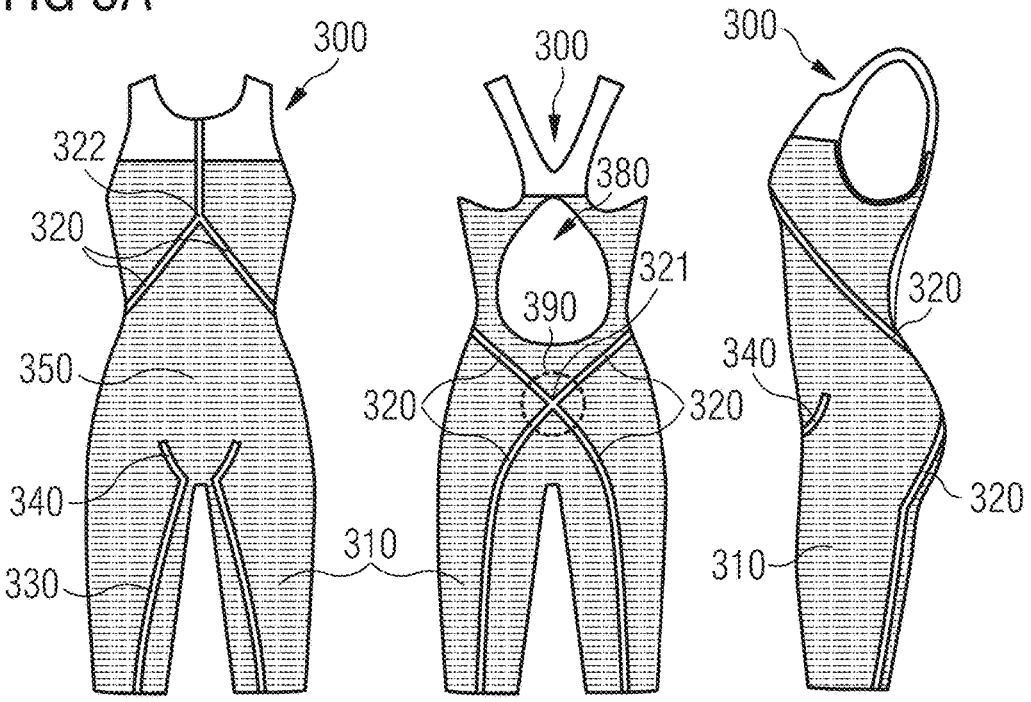
FIG. 3A shows front, rear, and side views of an article of sports apparel, according to certain embodiments of the present invention.

FIG. 3A shows embodiments for an article of sports apparel 300, in particular a swimsuit, which may be for freestyle swimming, and in particular for women. FIG. 3A shows a front view (left), a rear view (center) and a side view (right).

The swimsuit 300 may comprise at least one base portion 310, which may be provided similarly as explained above, e.g. with reference to FIG. 2. Swimsuit 300 may comprise an opening 380 in a region of the central back, e.g. a region of the thoracic vertebra, in which no base portion 310 is arranged. In other examples, no such opening is provided, e.g. similarly as in the example swimsuit 200 shown in FIG. 2.

Swimsuit 300 may comprise at least one elongate support element 320 which may be arranged at the at least one base portion 310 such as to extend outwardly from a region 390 at least partially encompassing the lower back of the user when worn, e.g. a first set of four elongate support elements 320 as in the example shown in FIG. 3. These four elongate support elements 320 may generally be provided as explained above, e.g. with reference to FIG. 2. For example, they may form a crossing 321, e.g. a single X-shaped crossing, in the region 390, similarly as explained above, e.g. with reference to FIG. 2. Moreover, they may for example form an intersection 322, similarly to intersection 222 as explained with reference to FIG. 2.

Swimsuit 300 may moreover comprise at least one further set of elongate support elements such as a set of two elongate support elements 330 and a set of two further elongate support elements 340, which may be similar to support elements 230 and 240 as explained with reference to FIG. 2.

The at least one base portion 310 and/or the at least one elongate support element 320, 330, 340 may be provided with further elements that may provide further functionalities and/or that may be provide the swimsuit with a desired outer appearance. For example, the at least one base portion 310 may be provided with printings 350.

Figure 3B:
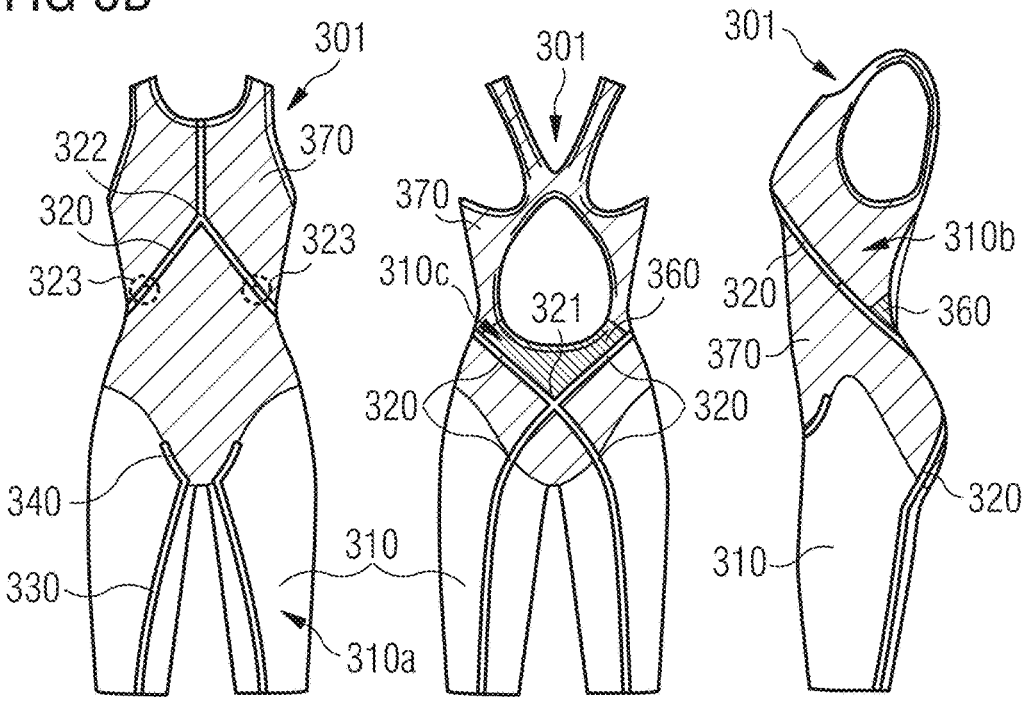
FIG. 3B shows front, rear, and side views of an article of sports apparel, according to certain embodiments of the present invention.

FIG. 3B shows another example for an article of sports apparel, which is provided as a swimsuit 301. Swimsuit 301 may be similar or identical to swimsuit 300 in many aspects, and like reference signs in FIG. 3B are intended to mark similar or identical items.

It is noted that, for example, the elongate support elements 320 extending around lateral hip regions upwards towards the chest region (cf. left side of FIG. 3B) may, in the example of swimsuit 301, be provided with at least one transition 323 (indicated by dashed circles in FIG. 3B). At a transition 323, for example, a material, a width, an elastic modulus, or any other property of the respective elongate support element 320 may change. A transition 323 may for example be provided at an elongate support element 320 at a lower end of the thorax, e.g. in a front lateral region thereof. A property, e.g. width, material, elastic modulus, etc., of the elongate support element 320 at one side of the transition 323 may differ from that of the elongate support element 320 at the other side of the transition 323. For example, the parts of the elongate support elements 320 extending above the transitions 323 as well as the elongate support elements 330 and 340 may comprise a material that differs from a material of the parts of the elongate support elements 320 extending below the transitions 323. For example, the former may comprise a lower elastic modulus than the latter. In other examples, at least one transition 323 may be arranged differently and/or at other elongate support elements 320, 330, or 340.

Moreover, swimsuit 301 may comprise at least one profile element 360 which may be arranged at the at least one base portion 310, e.g. similarly as the elongate support elements described herein. As shown in FIG. 3B, a profile element 360 may be arranged on a lower back region of the swimsuit 301, e.g. in an approximately triangular region. For example, the profile element 360 may be at least partly arranged above the lumbar vertebrae of the user. For example, the profile element 360 may extend symmetrically to the spine of the user. For example, the profile element 360 may be at least partly arranged above the crossing 321 and/or at least partly extend above the at least one profile element 320 forming the crossing 321. The profile element 360 may extend to a left and/or right lateral pelvis region. The profile element 360 may comprise at least one horizontal rib and/or a relatively rough fabric, e.g. rough as compared to a surface of at least one base portion and/or at least one elongate profile element.

Also other examples of sports apparel shown herein may generally comprise at least one profile element, e.g. similar to profile element 360 described with reference to FIG. 3B.

Furthermore, swimsuit 301 may comprise at least one artificial hollow fiber (which may be too small to be shown in this figure). In some examples, a first portion of the swimsuit 301 may have a different amount of artificial hollow fibers than a second portion of the swimsuit 301. For example, a first base portion 310*a*, e.g. extending in a thigh region of the user may have more artificial hollow fibers than a second base portion 310*b*, e.g. extending in a torso region of the user, for providing more buoyance so that the legs of the user are closer to the surface of the water. In addition, a third base portion 310*c*, e.g. extending symmetrically from the spine of the user, e.g. in the lower back, to a left and/or right lateral pelvis portion, may be without any artificial hollow fibers to avoid the influence of an increased buoyance. It has been found that such a portion without any artificial hollow fibers is particularly desirable in a region covering lumbar 5 and lumbar 4 vertebrae. For example, the third portion base portion 310*c* may be arranged in a region similarly as described with reference to profile element 360. In other examples, at least one portion with different amounts of artificial hollow fibers may be arranged differently in the swimsuit.

The swimsuit 301 may also comprise a lining 370 on the inner side of the at least one base portion 310, e.g. in similar areas in which the printing 350 is provided in the exemplary swimsuit 300. It is noted, however, that the lining 370 and the printing 350 may be applied fully independently from each other. Moreover, along the edges of openings of the swimsuit, e.g. on the back, or the openings for the arms, head, legs, etc., the at least one base portion may be provided with a binding, e.g. an elastic binding.

Figure 4:
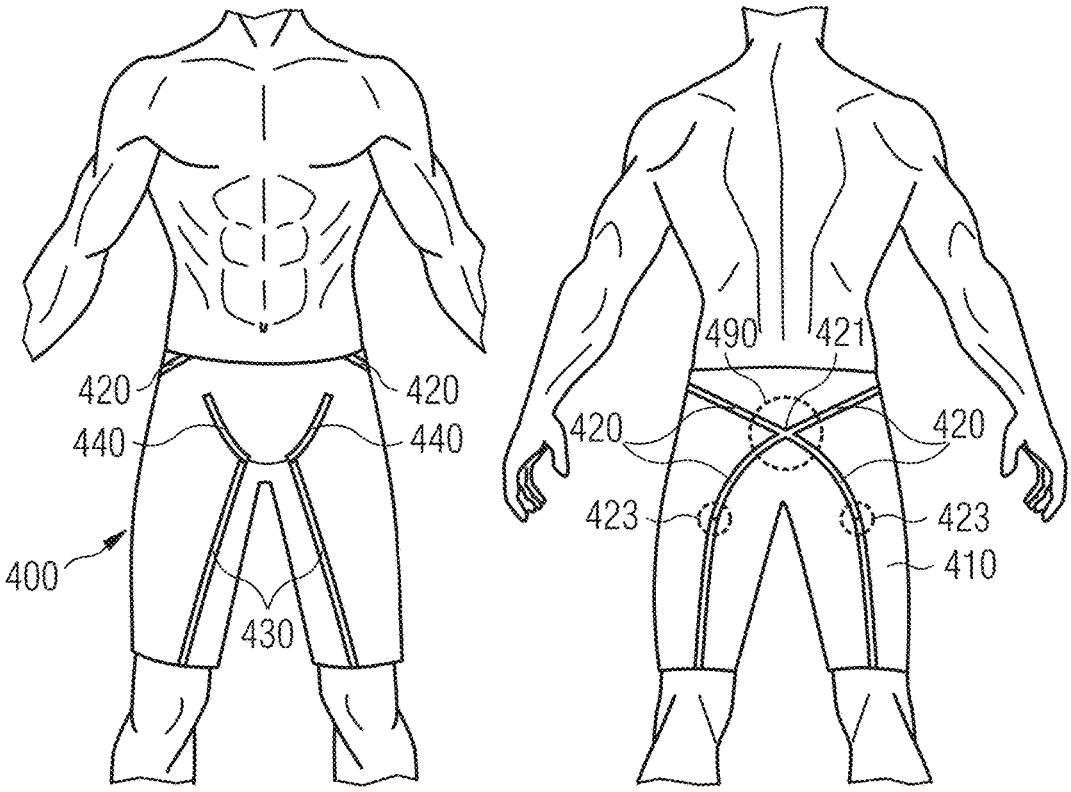
FIG. 4 shows front and rear views of an article of sports apparel, according to certain embodiments of the present invention.

FIG. 4 shows a further example of an article of sports apparel, in particular a swimsuit 400, which may specifically be adapted to be used by men, and particularly suitable for freestyle swimming. The left part of FIG. 4 shows a front view of the swimsuit 400 and the right part shows a rear view of the swimsuit 400.

The swimsuit 400 may comprise at least one base portion 410, which may generally be arranged similarly as explained above, e.g. with reference to FIGS. 2 and 3A-B. However, the base portions 410 may not be arranged at an upper part of the body of a user, e.g. as shown in the exemplary swimsuit 400 of FIG. 4.

The swimsuit 400 may comprise elongate support elements 430 and 440 whose geometry may generally be similar or identical to that as explained above, e.g. with reference to elongate support elements 230, 330 and 240, 340 of swimsuits 200 and 300/301, respectively.

In addition, swimsuit 400 may comprise at least one further elongate support element 420 which may be arranged at (e.g. on an outer side of) the at least one base portion 410 such as to extend outwardly from a region 490 at least partially encompassing the lower back of the user when worn. For example, four such elongate support elements may be provided as in the example shown in FIG. 4. The region 490 may be adapted as explained above, e.g. with reference to FIGS. 2 and 3A-B. The four elongate support elements 420 may form a crossing, e.g. with an X-shape, in the region 490, as explained above, e.g. with reference to FIGS. 2, 3A-B. However, an angle formed by the two elongate support elements 420 extending upwards and/or by the two elongate support elements 420 extending downwards with the spine of the user may be larger than that in the example swimsuits 200, 300, 301.

The two elongate support elements 420 extending upwards may extend upwards around a lateral pelvis region. These two elongate support elements 420 may terminate at left and right sides of a front pelvis region, e.g. at an upper rim in this region, of the swimsuit 400. The two elongate support elements 420 may have an approximately constant slope with respect to the spine of the user.

In certain embodiments, the two elongate support elements 420 extending downwards may be provided similarly to the corresponding elongate support elements 220 or 320 of swimsuits 200, 300/301, respectively. They may extend across a pelvis regions and/or left and right buttocks regions and they may also extend along left and right thigh regions, respectively, of the rear side of the swimsuit 400, e.g. until they reach a lower rim of the swimsuit 400. In particular, each elongate support element 420 may comprise a bending in the pelvis region or in the left/right buttocks region towards the direction of the spine (making the angle to the spine more acute). The elongate support elements 420 may extend approximately vertically in the thigh regions, e.g. approximately parallel to the femur.

The two elongate support elements 420 extending downwards may be provided with at least one transition 423 (indicated by dashed circles in FIG. 4). For example, as shown in FIG. 4 each of these elongate support elements 420 may comprise a transition in a left or right, respectively, region at the interface of a buttocks region and a thigh region. At a transition 423, similarly as explained with transitions 323 of swimsuit 300, a material, a width, an elastic modulus, or any other property of the respective elongate support element 420 may change. A property, e.g. width, material, elastic modulus, etc., of the elongate support element 420 at one side of the transition 423 may differ from that of the elongate support element 420 at the other side of the transition 423. In other examples, at least one transition 423 may be arranged differently and/or on other elongate support elements 420, 430, or 440.

For example, the parts of the elongate support elements 420 extending above the transitions 423 as well as, for example the elongate support elements 430 may comprise a material that differs from a material of the parts of the elongate support elements 420 extending below the transitions 423 and, for example, the elongate support elements 440. For example, the former may comprise a lower elastic modulus than the latter.

The at least one base portion 410 and/or the at least one elongate support element 420, 430, 440 may be provided with further elements that may provide further functionalities and/or that may be provide the swimsuit 400 with a desired outer appearance. For example, the at least one base portion 410 may be provided with printings, which may e.g. be similar to printings 350 of swimsuit 300, and/or with at least one profile element, e.g. similar to profile element 360 as described with reference to FIG. 3B.

Figure 5A:
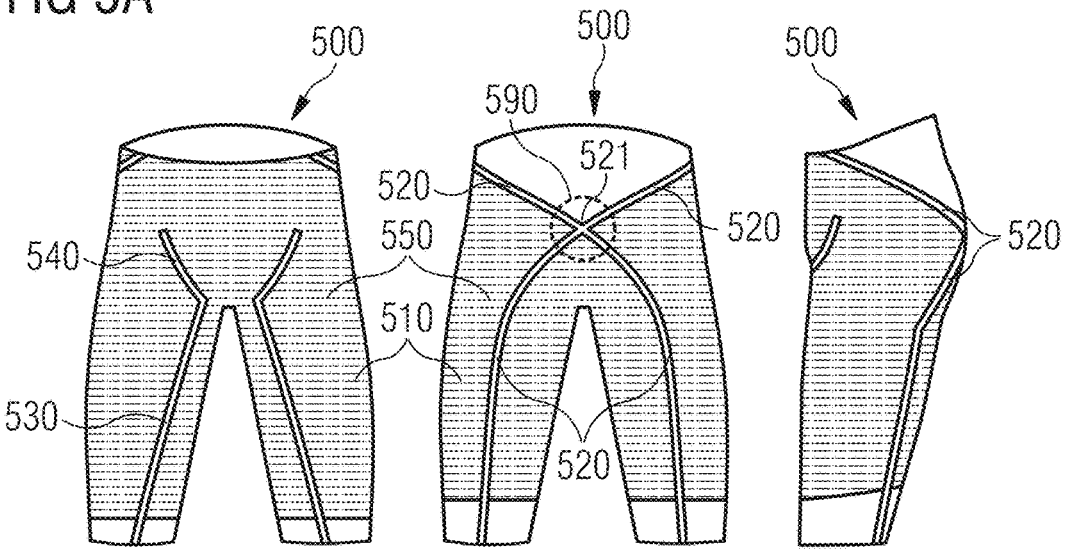
FIG. 5A shows front, rear, and side views of an article of sports apparel, according to certain embodiments of the present invention.

FIG. 5A shows an example of an article of sports apparel, in particular a swimsuit 500, which may be used for freestyle swimming, and in particular for men. FIG. 5A shows a front view (left), a rear view (center) and a side view (right) of swimsuit 500.

The swimsuit 500 may comprise at least one base portion 510, which may be provided similarly as explained above, e.g. with reference to FIGS. 2, 3A-B and 4.

Swimsuit 500 may comprise at least one elongate support element 520 which may be arranged at, e.g. on an outer side of, the at least one base portion 510 such as to extend outwardly from a region 590 at least partially encompassing the lower back of the user when worn, e.g. a first set of four elongate support elements 520 as in the example shown in FIG. 5A. These four elongate support elements 520 may generally be provided as explained above, e.g. with reference to FIGS. 2, 3A-B and 4. For example, they may form a crossing 521, e.g. a single X-shaped crossing, in the region 590, as also explained above, e.g. with reference to FIGS. 2, 3A-B, 4. The elongate support elements 520 may in some examples not have any transitions, as e.g. the elongate support elements 420 of exemplary swimsuit 400.

Swimsuit 500 may moreover comprise at least one further set of elongate support elements such as a set of two elongate support elements 530 and a set of two further elongate support elements 540, which may be similar to support elements 430 and 440 as explained with reference to FIG. 4. In some examples, the elongate support elements 520, 530, and 540 of swimsuit 500 may be provided with the same material, the same material properties, e.g. the same elastic modulus, elasticity, etc.

The at least one base portion 510 and/or the at least one elongate support element 520, 530, 540 may be provided with further elements that may provide further functionalities and/or that may be provide the swimsuit with a desired outer appearance. For example, the at least one base portion 510 may be provided with printings 550, e.g. as explained with reference to printings 350 of FIGS. 3A-B.

The at least one base portion 510 and/or the at least one elongate support element 520, 530, 540 may be provided with further elements that may provide further functionalities and/or that may be provide the swimsuit 500 with a desired outer appearance. For example, the at least one base portion 510 may be provided with printings, which may e.g. be similar to printings 350 of swimsuit 300, and/or with at least one profile elements, e.g. similar to profile element 360 as described with reference to FIG. 3B.

Figure 5B:
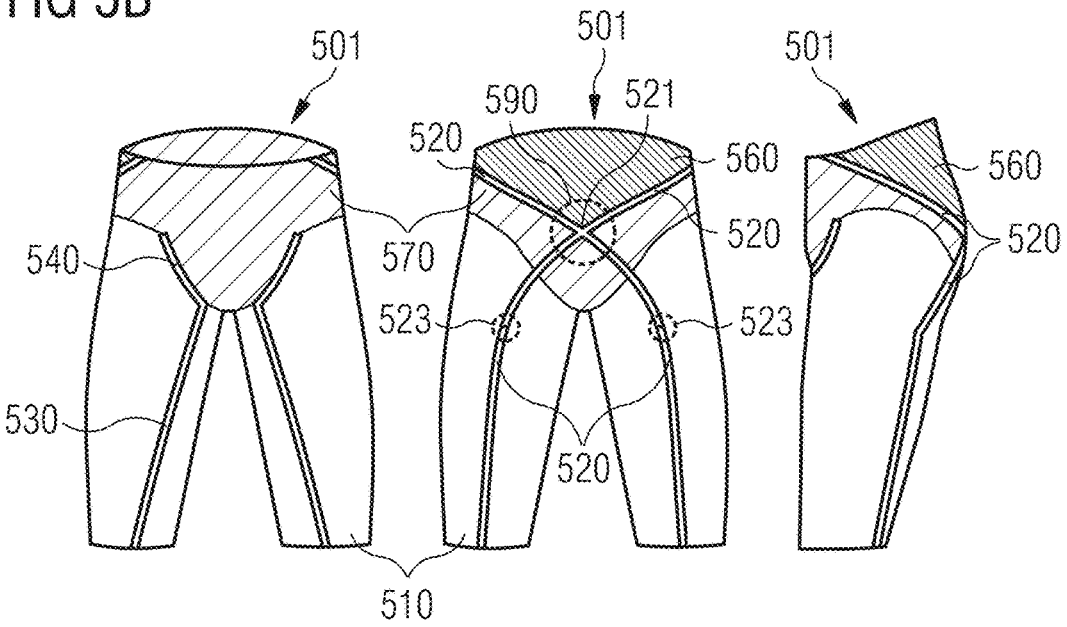
FIG. 5B shows front, rear, and side views of an article of sports apparel, according to certain embodiments of the present invention.

FIG. 5B shows a further example for an article of sports apparel, which is provided as a swimsuit 501. Swimsuit 501 may be similar or identical to swimsuit 500 in many aspects, and like reference signs in FIG. 5B are intended to mark such similar or identical items.

It is noted that, for example, the elongate support elements 520 extending downwards from the region 590 in the lower back of the user when worn may, in the example of swimsuit 501, be provided with at least one transition 523 (indicated by dashed circles in FIG. 5B), similarly to transitions 423 as already explained with reference to FIG. 4. In other examples, at least one transition 523 may be arranged differently and/or on other elongate support elements 520, 530, or 540.

Moreover, swimsuit 501 may comprise at least one profile element 560. According to FIG. 5B, the swimsuit 501 comprises a single profile element 560 which may generally be provided similarly or identically as the profile elements explained above, e.g. profile element 360 explained with reference to FIG. 3B.

The swimsuit 501 may also comprise a lining 570 on the inner side of the at least one base portion 510, e.g. in the region of the base portions 510 around a genital area of the user. Moreover, a waistband may be bonded on an inner side of the at least one base portion 510 such that putting on the swimsuit 501 and a tight fit of the swimsuit 501 may be facilitated.

Figure 6A:
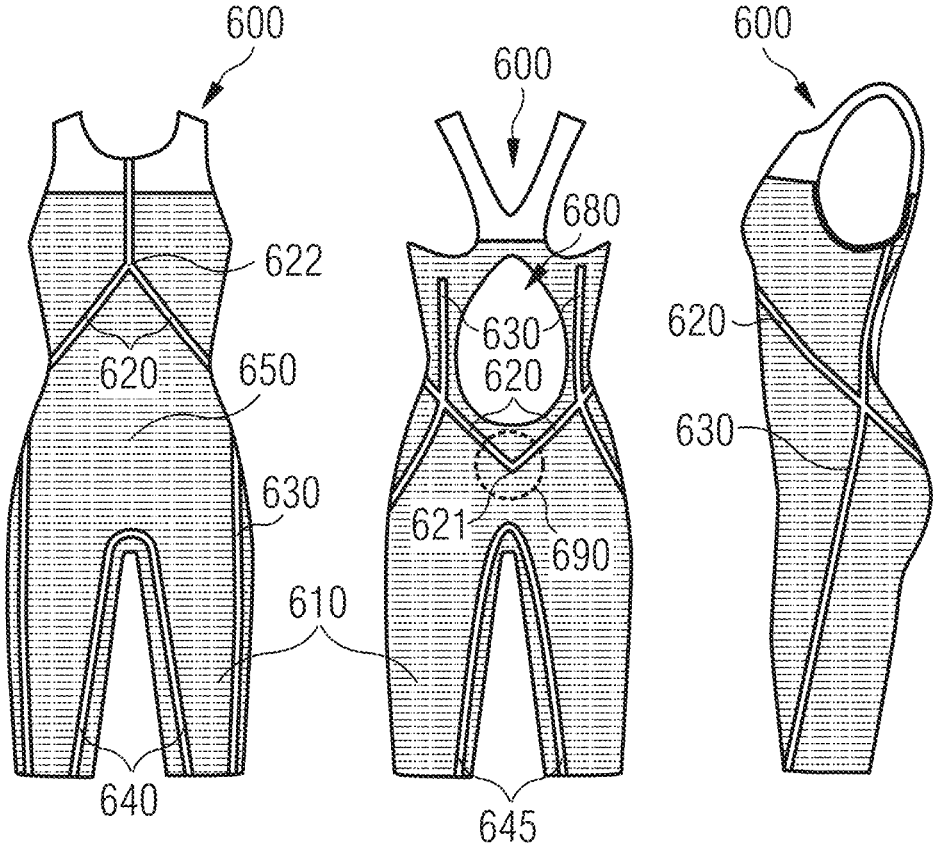
FIG. 6A shows front, rear, and side views of an article of sports apparel, according to certain embodiments of the present invention.

FIG. 6A shows an example for an article of sports apparel, in particular a swimsuit 600, that may be adapted for women, particularly for breaststroke swimming. The swimsuit 600 may comprise at least one base portion 610 similarly as explained above, e.g. with reference to FIGS. 2 and 3A-B. An opening 680 may be formed by the at least one base portion 610 in a region of the central back, e.g. a region of the thoracic vertebra, in which no base portions 610 are arranged. In other examples, no such opening is provided, e.g. similarly as in the example swimsuit 200 shown in FIG. 2. In addition, the swimsuit 600 may comprise at least one elongate support element 620, 630, 640, 645.

A first set of at least one elongate support elements 620, in the example of FIG. 6A, a first set of two elongate support elements 620, may be arranged at the at least one base portion 610 such as to extend outwardly from a region 690 at least partially encompassing the lower back of the user when worn. These two elongate support elements 620 may extend upwards and may generally be provided as explained above, for example similarly or identically, e.g. with similar or identical geometry, properties, materials, etc., as corresponding upwardly extending elongate support elements 220, 320, 420, 520 of swimsuits 200, 300/301, 400, 500/501, respectively. Similarly, region 690 may be arranged as explained above, e.g. similarly as corresponding regions 290, 390, 490, 590 explained with reference to FIGS. 2, 3A-B, 4, 5A-B.

In some embodiments, the two elongate support elements 620 may extend upwards from the region 690, with an acute angle to the spine, and may form a V-shaped crossing over the region 690. The two elongate support elements 620 may extend around a lateral torso region of the swimsuit 600, e.g. around a lateral thorax region, e.g. around a lower lateral thorax region, or a lateral region between the pelvis and the lowest ribs. They may further extend diagonally upwards in a front region of the swimsuit 600, e.g. along a lower rim of the thorax, e.g. towards the sternum. The two elongate support elements 620 may intersect each other in a front torso region, in particular in a chest region, e.g. above the sternum, such that an intersection 622 may be formed, there. Above the intersection 622, a further elongate support element may extend upwards vertically to an upper torso region of the swimsuit 600, e.g. until an upper rim of the swimsuit 600 is reached.

A further set of at least one elongate support elements 630 may be arranged at the at least one base portion 610. In the example of FIG. 6A, two such elongate support elements 630 are provided. These elongate support elements 630 extend in a front region of the swimsuit 600, in particular along a left and right, respectively, lateral thigh region, e.g. approximately parallel to the femur, in some embodiments, from a lower rim of swimsuit 600 through the entire lateral thigh region. The two elongate support elements may continue to extend upwards through a pelvis region and extend around a lateral torso region, e.g. a lateral pelvis region, or a lateral region between the pelvis and the lowest ribs, or a lateral region along an upper rim of the pelvis bone. They may then continue to extend upwards, approximately vertically, in a rear region of the swimsuit 600. The two elongate support elements 630 may extend upwards in lateral rear torso regions, e.g. to the left and right, respectively, of opening 680, e.g. until they reach an upper rim of swimsuit 600.

The swimsuit 600 may moreover comprise a further set of at least one elongate support elements 640 which may be arranged at the at least one base portion 610. In the example of FIG. 6A, two such elongate support elements 640 are provided. They may extend from a lower rim of the swimsuit 600 in a medial thigh region of the swimsuit, approximately vertically upwards, e.g. approximately parallel to the femur. They may continue to extend over a groin region of the swimsuit 600. In the groin region, the two elongate support elements 640 may bend towards each other and, optionally, join.

The swimsuit 600 may moreover comprise a further set of at least one elongate support element 645 which may be arranged at the at least one base portion 610. In the example of FIG. 6A, two such elongate support element 645 are provided. They may generally be provided similarly as elongate support elements 640 described above. However, while the elongate support element 640 are arranged on a front region of the swimsuit 600, the elongate support elements 645 may be arranged at a back region of the swimsuit 600.

Elongate support elements which provide a force-fit between left and right thighs, e.g. on medial sides of each thigh, such as elongate support elements 640 and 645 may particularly help to improve the leg-stroke of breaststroke swimmers. They may support the movement of the legs towards each other. For example, during the movement of the legs away from each other (which is typically a more powerful movement than moving the legs towards each other) the elongate support elements are elongated, and the force may elastically be returned when moving the legs towards each other. In particular, the forces may thus be distributed more evenly in a stroke cycle.

The at least one base portion 610 and/or the at least one elongate support element 620, 630, 640, 645 may be provided with further elements that may provide further functionalities and/or that may be provide the swimsuit 600 with a desired outer appearance. For example, the at least one base portion 610 may be provided with printings 650, which may e.g. be similar to printings 350 of swimsuit 300, and/or with at least one profile element, e.g. similar to profile elements 360 or 560 as described with reference to FIGS. 3B and 5B, respectively.

Figure 6B:
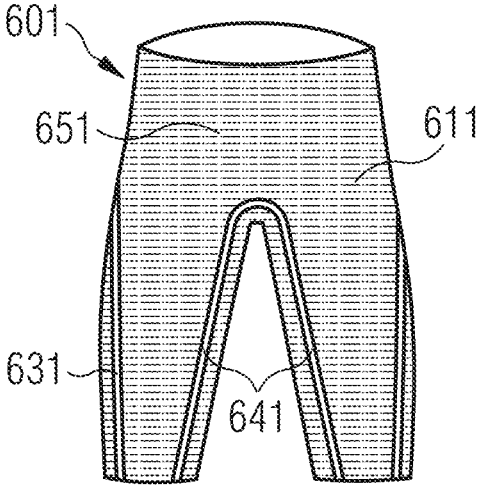
FIG. 6B shows a front view of an article of sports apparel, according to certain embodiments of the present invention.

FIG. 6B shows a further example for an article of sports apparel, namely swimsuit 601, which may be adapted for use by men, and in particular for breaststroke swimming. Swimsuit 601 may comprise at least one base portion 611 which may generally be provided similarly as explained above, e.g. with reference to FIG. 6A. However, in the swimsuit 601 no base portions 611 may be provided in the upper part of the body of a user. Swimsuit 601 may comprise at least one elongate support element, e.g. two elongate support elements 631 and two elongate support element 641. These may be similar to elongate support elements described above, e.g. similar to elongate support elements 630 and 640, respectively, of swimsuit 600. Swimsuit 601 may also be provided with further elongate support elements similar to elongate support elements 645 of swimsuit 600. Swimsuit 601 may comprise at least one further elongate support element and/or further parts which may provide further functionalities and/or that may be provide the swimsuit 600 with a desired outer appearance. For example, the at least one base portion 611 may be provided with printings 651, which may e.g. be similar to printings 550 of swimsuit 500.

Figure 7A:
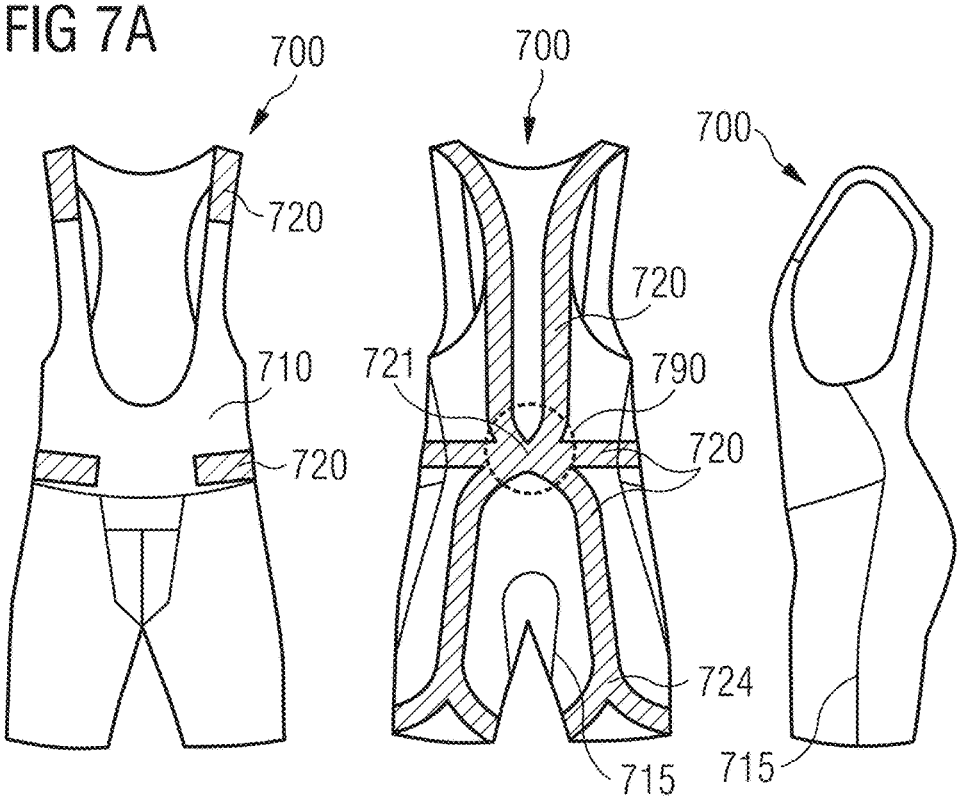
FIG. 7A shows front, rear, and side views of an article of sports apparel, according to certain embodiments of the present invention.

FIG. 7A shows an example for an article of sports apparel, namely a suit 700 which may be used for athletic sports, in particular for rugby football. In particular, the suit 700 may particularly be used by forwards of a rugby team. However, it is noted that suit 700 may also be adapted as underwear or sportswear for athletic sports in general, e.g. track and field, cycling, weightlifting, etc.

The suit 700 may comprise at least one base portion 710. The at least one base portion 710 may be arranged on rear and front thigh regions, a pelvis region, a center region of the back extending from the lower to the upper back. The at least one base portion may be adapted to be arranged proximate a lower back of a user when worn. The at least one base portion 710 may also be arranged to form two vertical straps in a chest region of the user.

FIG. 7A shows front and rear views of the inner side of the suit 700 (left and center) as well as a side view of the outer side of the suit 700 (right). The suit 700 in the example of FIG. 7 comprises a plurality of base portions which are connected to each other via a plurality of seams 715.

The suit 700 may comprise at least one elongate support element 720, which may be arranged at an inner side of the at least one base portion 710. In particular at least three elongate support elements 720 extend outwardly from a region 790 at least partially encompassing the lower back of the user when worn. The region 790 may generally be provided as described above, e.g. with reference to FIGS. 2-6. In the example of FIG. 7A, six elongate support elements 720 extend outwardly from the region 790. They form a crossing 721 over the spine in region 790.

A first set of elongate support elements 720, e.g. a set of two as shown in the example of FIG. 7A, extends approximately horizontally to the left and right, respectively, from region 790. They may be approximately perpendicular to the spine. They may extend through a rear pelvis region, around a lateral pelvis region of the suit 700. They may for example terminate on a left and right, respectively, side of the front pelvis region. The mentioned pelvis regions may be upper pelvis regions and/or regions between the pelvic bone and the thorax. In other examples, the two elongate support elements 720 may meet at the front side of the swimsuit 700.

A second set of two elongate support elements 720, e.g. a set of two as shown in the example of FIG. 7A, may extend upwards from the region 790. They may each form an angle of 30° to 60°, approximately 45°, with the spine at the crossing 721. They may then be curved towards the spine (i.e. their angle to the spine gets more acute) and extend upwards towards a shoulder region of the swimsuit. The two elongate support elements 720 may extend approximately parallel and approximately adjacent to the spine in a region of the thoracic vertebrae. They may then continue upwards and bend towards left and right, respectively, shoulder regions of suit 700. The two elongate support elements 720 may then extend around the left and right, respectively, shoulder regions and continue downwards at a front region of the suit 700. They may for example terminate a chest region at a front region of suit 700.

In certain embodiments, a third set of elongate support elements 720, e.g. a set of two as shown in the example of FIG. 7A, may extend downwards from the region 790. They may each form an angle of 40° to 80°, approximately 60°, with the spine at the crossing 721. They may then be curved towards the spine (i.e. their angle to the spine gets more acute) and extend downwards across the pelvis region of suit 700 towards left and right thigh regions, respectively, of the suit 700. The two elongate support elements 720 may extend approximately parallel to the femur in the upper thigh regions towards the lower thigh regions. Slightly above a lower rim of the suit 700 in the lower thigh regions, each of the two downwardly extending elongate support elements 720 may comprise a fork 724. Below the fork 724, each elongate support element 720 may split into two elongate support elements which may extend to the left and right, respectively, in the lower thigh region of the suit 700. The two split elongate support elements may optionally meet in a front left and right thigh region of the suit 700, such that left and right thigh regions are circumscribed by an elongate support element 720.

For the rest, the elongate support elements 720, base portions 710 and suit 700 may, additionally or alternatively, be provided with features as described above, e.g. with reference to FIGS. 2-6.

Figure 7B:
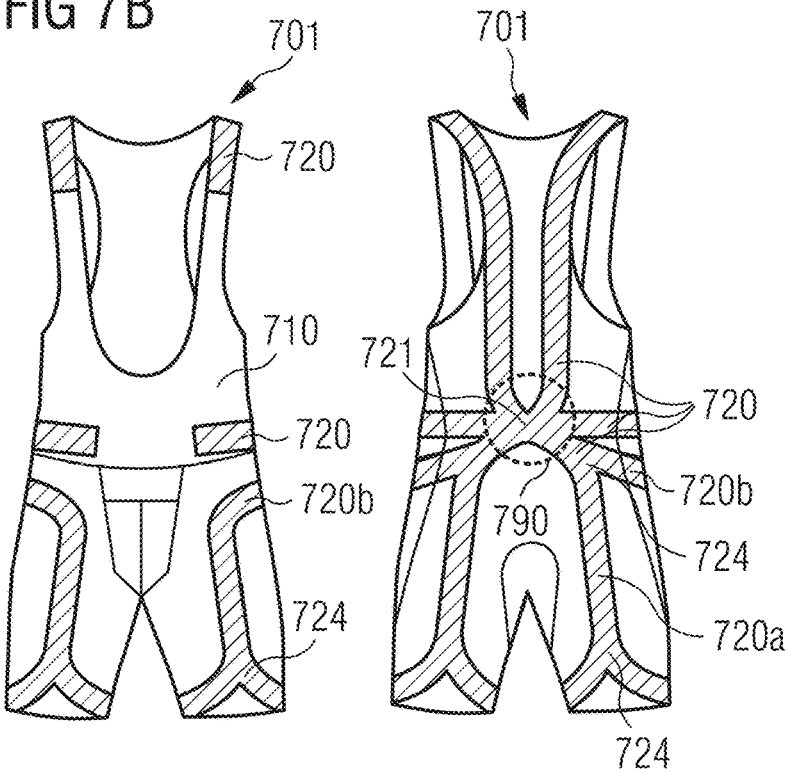
FIG. 7B shows front and rear views of an article of sports apparel, according to certain embodiments of the present invention.

FIG. 7B shows a further example of an article of sports apparel, namely a suit 701 which may be used for athletic sports, in particular for rugby football. In particular, the suit 701 may be similar in many aspects to suit 700, but particularly be adapted for use by backs of a rugby team. Like numerals in FIGS. 7A and 7B designate similar or identical items.

FIG. 7B shows front and rear views of the inner side of the suit 701 (left and right). The suit 701 may comprise at least one base portion 710, which may be connected via at least one seam, similarly as suit 700. The suit 701 may moreover comprise at least one elongate support element 720, which may be arranged at an inner side of the suit 700, and in particular at least three elongate support elements 720 (six in the example of FIG. 7B) may extend outwardly from the region 790, similarly as described with reference to suit 700.

The suit 701 may comprise two elongate support elements 720 extending upwards and two elongate support elements 720 extending horizontally. These may be provided in a similar manner as corresponding elongate support elements 720 of suit 700. Also region 790 may be provided in a similar manner as that of suit 700.

However, the suit 701 may comprise two elongate support elements 720 extending downwards, which may be different from those of suit 700. In particular, besides the fork 724 in the lower thigh regions, as already explained with reference to suit 700, the two elongate support elements 720 extending downwards may comprise another fork in a left and right, respectively, rear pelvis region. Each elongate support elements 720 comprises two split elongate support elements 720*a* and 720*b* which extend from the fork 724 in the left and right, respectively, rear pelvis region. A first elongate support element 720*a* extends downward to the upper and lower rear thigh region and is essentially identical to the corresponding elongate support element 720 of suit 700 in these regions. A second elongate support element 720*b* extends towards a lateral pelvis region and around a lateral pelvis region. It may continue to extend on a lateral pelvis region in the front region of the suit 701 and then continue to extend in an upper and lower front thigh region. The second elongate support element 720*b* may comprise a further fork 724 in the lower front thigh region. Two split elongate support elements may extend to the right and right, respectively, in the lower front thigh region. Essentially, the first and second elongate support elements may comprise an identical geometry in the rear and front thigh regions of the suit 701, respectively. The split elongate support elements formed on both the front and rear lower thigh regions may optionally meet such that they circumscribe the thigh region, e.g. the lower thigh region.

Figure 8:
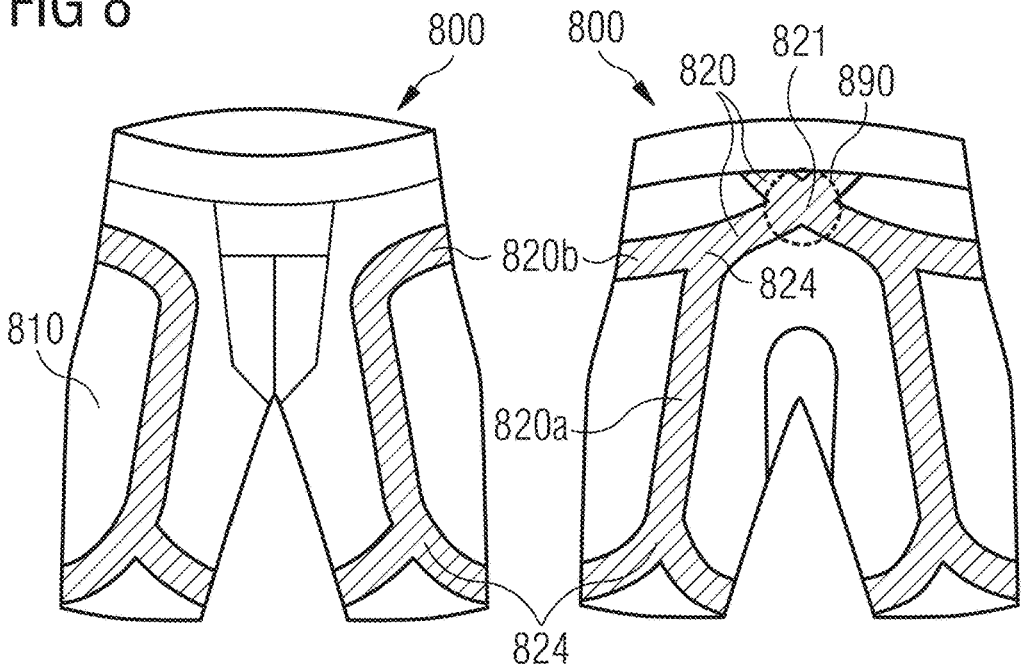
FIG. 8 shows front and rear views of an article of sports apparel, according to certain embodiments of the present invention.

FIG. 8 shows a further example of an article of sports apparel, namely a pair of sports pants 800. The pants 800 may be adapted as underwear or sportswear for athletic sports in general, e.g. track and field, cycling, weightlifting, etc. The pants 800 may comprise at least one base portion 810. The at least one base portion may be arranged around rear and front thigh regions and a pelvis region of the user. The at least one base portion 810 may thus be adapted to be arranged proximate a lower back of a user when worn. Generally, the at least one base portion 810 of pants 800 may be similarly arranged as the base portions 710 of suit 700 or suit 701. However, pants 800 may not have any base portions 810 arranged in an upper part of the body of the user.

Moreover, the pants 800 may comprise at least one elongate support element 820, which may be arranged at an inner side of the at least one base portion 810. In particular at least three elongate support elements 820 may extend outwardly from a region 890 at least partially encompassing the lower back of the user when worn. The region 890 may generally be provided as described above, e.g. with reference to FIGS. 2-7. In the example of FIG. 8, four elongate support elements 820 extend outwardly from the region 890. They form a crossing 821 over the spine in region 890.

Two of the elongate support elements 820 extend downwardly. These may be provided similarly or identically as explained with reference to the downwardly extending elongate support elements 720 of suit 701.

Two of the elongate support elements 820 extend upwardly. They may extend to an upper rim of pants 800, or for example as shown in FIG. 8, terminate in a lumbar region.

Figure 9:
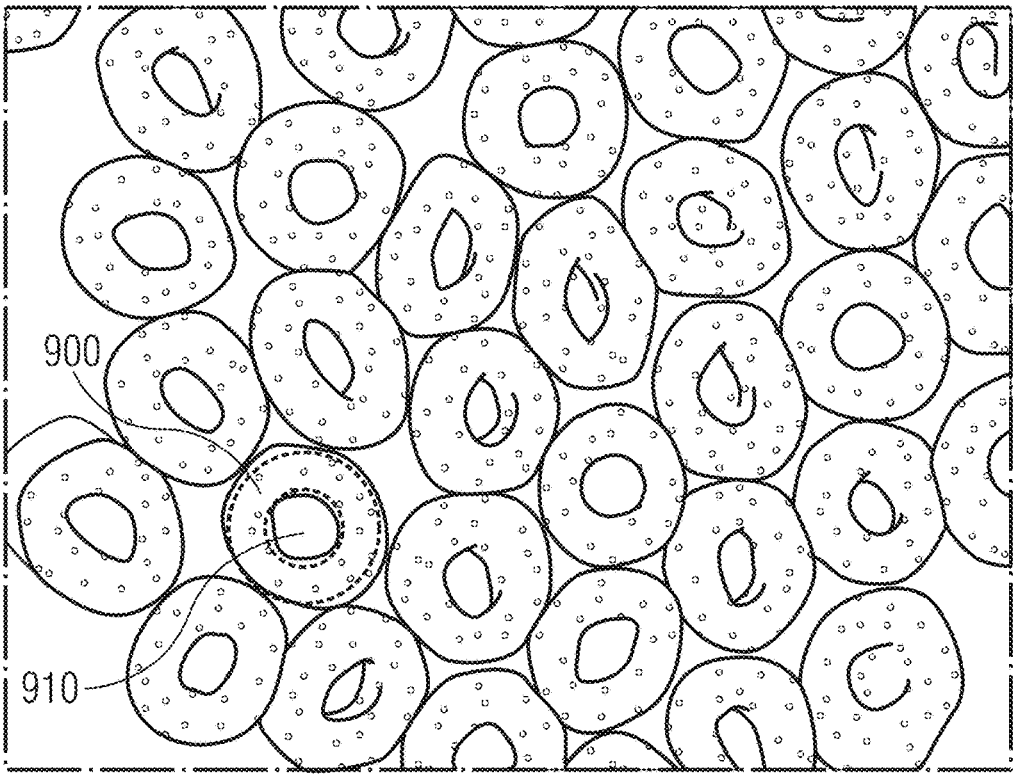
FIG. 9 shows a magnified view of artificial hollow fibers, according to certain embodiments of the present invention.

In the following, further details regarding the options for providing articles of sports apparel with at least one artificial hollow fiber will be described: FIG. 9 shows an example of a microscopy picture of a plurality of artificial hollow fibers 900 in cross-section. As may be seen, the cross-section of an artificial hollow fiber 900 may have an essentially cylindrical outer shape (in FIG. 9 indicated by a dotted line) and may have a diameter of 1 μm to 50 μm, 10 μm to 30 μm, or 15 μm to 20 μm. However, in other embodiments (not shown), the cross-section of the artificial hollow fiber is not cylindrical but may be elliptical or have any other suitable shape.

In the embodiments shown in FIG. 9, the artificial hollow fiber 900 comprises at least one internal cavity 910. In the disclosed embodiments, such cavities also have an essentially cylindrical cross-section (in FIG. 9 indicated by a dotted line) which may have a diameter of 1 μm to 20 μm, or 5 μm to 10 μm. Again, other cross-sections of regular or irregular shape are utilized in some embodiments. Moreover, there might be a plurality of isolated cavities in an artificial hollow fiber rather than the continuous cavity 910 shown in FIG. 9.

The artificial hollow fibers 900 shown in FIG. 9 may be produced by various techniques, for example by a wet spinning process. In such a process, the fiber is made from a solution of a polymer, e.g. from a solution of polyamide, by extruding the solution through a spinning nozzle around a central fluid. After falling into a precipitation bath with additional solvents, the central fluid dissolves and the artificial hollow fiber may be processed by additional processing steps. For example, the fiber may be processed to form a filament. Furthermore, a plurality of such filaments made from artificial hollow fibers may be spun to form a yarn. Alternatively, also short hollow fibers may be processed to form a yarn. In addition to the artificial hollow fibers, such a yarn may also include other fibers, for example elastic fibers such as they are known and available under the name elastane. The percentage of the artificial hollow fibers and other fibers in such a mixed yarn may vary and may define its properties, such a buoyance and elasticity.

As mentioned, an aspect of the present invention may relate to a manufacturing method which may be used to manufacture any of the articles of sports apparel described herein.

A pressing of at least one elongate support element on at least one base portion may be carried out at a temperature in the range of 100° C. and 180° C., or 160° C. to 180° C., in some embodiments, in the range of 125° C. and 140° C. The pressing may be carried out as flat-pressing, e.g. with a pressure of 2 bar to 6 bar, or 2.8 bar to 4.1 bar. The pressing may be carried out for a duration of 15 seconds to 40 seconds, or 20 seconds to 30 seconds.

In other examples, the pressing may be carried out at a temperature in the range from 180° C. to 270° C., or 200° C. to 250° C. The pressing may be carried out by a continuous bonding machine, e.g. at a speed of 0.5 m/s to 3 m/s, or 1.5 m/s to 2 m/s. The pressing may be carried out at a pressure of 0.5 bar to 2 bar, e.g. 0.8 bar to 1.2 bar.

In some examples, the manufacturing method may include providing an adhesive. For example, at least one elongate support element may comprise an adhesive, e.g. an adhesive layer. The adhesive may have a softening point of approximately 70° C. to 100° C., or 80° C. to 85° C. During the pressing step, the adhesive may be heated up to a temperature in the range of 100° C. to 150° C. or of 120° C. to 130° C. An activation temperature of the adhesive may be in that range of temperatures. The adhesive may be provided with a thickness of 10 μm to 200 μm, 20 μm to 100 μm, or 40 μm to 60 μm.

In the following, further examples are described to facilitate the understanding of the invention:

Example 1

Article of sports apparel comprising:

a. at least one base portion (210; 310; 410; 510; 710; 810) adapted to be arranged proximate a lower back of a user when worn;

b. at least three elongate support elements (220; 320; 420; 520; 720; 820);

c. wherein the at least three elongate support elements are arranged at the base portion such as to extend outwardly from a region at least partially encompassing the lower back of the user when worn (290; 390; 490; 590; 790; 890).

Example 2

Article of sports apparel comprising:

a. at least one base portion (210; 310; 410; 510; 710; 810) adapted to be arranged proximate a lower back of a user when worn;

b. at least two elongate support elements (220; 320; 420; 520; 720; 820);

c. wherein the at least two elongate support elements are arranged at the base portion such as to extend outwardly from a region at least partially encompassing the lower back of the user when worn (290; 390; 490; 590; 790; 890) in a non-axially-symmetric manner with respect the spine.

Example 3

Article of sports apparel according to Example 1 and Example 2, wherein at least one of the elongate support elements (220; 320; 420; 520; 720; 820) is adapted to form at least one crossing (221; 321; 421; 521; 721; 821) over the spine.

Example 4

Article of sports apparel according to any of Examples 1-3, wherein an angle between at least one of the elongate support element (220; 320; 420; 520; 720; 820) and the spine is in the range from 30° to 80°, in some embodiments, from 45° to 75°, particularly from 50° to 71°.

Example 5

Article of sports apparel according to any of Examples 1-4, wherein the region (290; 390; 490; 590; 790; 890) is positioned between a lower end of a sacrum of the user and an upper end of a next to lowest lumbar vertebra of the user when worn, in particular between the sacrum of the user and the next to lowest lumbar vertebra of the user when worn.

Example 6

Article of sports apparel according to any of Examples 1-5, wherein at least one of the elongate support elements (220; 320; 420; 520; 720; 820) is at least partially arranged proximate an inner and/or an outer surface of the at least one base portion (210; 310; 410; 510; 710; 810).

Example 7

Article of sports apparel according to any of Examples 1-6, wherein at least one of the elongate support elements (720) is at least partly arranged at an inner and/or an outer surface proximate a seam (715) of the at least one base portion (710).

Example 8

Article of sports apparel according to any of Examples 1-7, wherein at least one of the elongate support elements (220; 320; 420; 520; 720; 820) comprises a thickness between 0.3 mm and 0.8 mm, in some embodiments, between 0.4 mm and 0.7 mm, and in some embodiments, 0.6 mm.

Example 9

Article of sports apparel according to any of Examples 1-8, wherein at least one of the elongate support elements (220; 320; 420; 520; 720; 820) comprises a polymer, in some embodiments, a thermoplastic elastomer, and, in some embodiments, a polyurethane.

Example 10

Article of sports apparel according to any of Examples 1-9, wherein at least one of the elongate support elements (220; 320; 420; 520; 720; 820) comprises a fabric.

Example 11

Article of sports apparel according to any of Examples 1-10, wherein the at least one of the elongate support elements (220; 320; 420; 520; 720; 820) is attached to the at least one base portion (210; 310; 410; 510; 710; 810) by a discontinuous adhesive, in particular a web-shaped adhesive.

Example 12

Article of sports apparel according to any of Examples 1-11, wherein at least one of the elongate support elements (220; 320; 420; 520; 720; 820) has a higher elastic modulus than the at least one base portion (210; 310; 410; 510; 710; 810).

Example 13

Article of sports apparel according to any of Examples 1-12, wherein an elastic modulus of at least one of the elongate support elements (220; 320; 420; 520; 720; 820) is lower in a direction along the at least one of the elongate support elements compared to a direction orthogonal to the at least one of the elongate support elements.

Example 14

Article of sports apparel according to any of Examples 1-13, wherein at least one of the support elements (220; 320; 420; 520; 720; 820) extends at least partly around a lateral torso region of the article of sports apparel.

Example 15

Article of sports apparel according to any of Examples 1-14, wherein at least one of the elongate support elements (220; 320; 420; 520; 720; 820) extends at least partly around a lateral pelvis region and/or a lateral thorax region and/or a shoulder region of the article of sports apparel.

Example 16

Article of sports apparel according to Example 14 or 15, wherein at least two of the elongate support elements (220; 320) intersect each other in a front region of the article of sports apparel, in particular in a breast region of the article of sports apparel.

Example 17

Article of sports apparel according to any of Examples 1-16, wherein at least one of the elongate support elements (720; 820) circumscribes a leg region of the article of sports apparel.

Example 18

Article of sports apparel according to any of Examples 1-17, wherein at least one of the elongate support elements (220; 320; 420; 520; 720; 820) extends in a front region and/or a back region of a thigh region of the article of sports apparel.

Example 19

Article of sports apparel according to any of Examples 1-18, wherein at least one of the elongate support elements extends in a groin region of the article of sports apparel.

Example 20

Article of sports apparel according to any of Examples 1-19, further comprising a profile element (360; 560) arranged at the at least one base portion (310; 510) and proximate the lower back of the user when worn.

Example 21

Article of sports apparel according to any of Examples 1-20, wherein the at least one base portion (210; 310; 310*a*; 310*b*, 410; 510; 710; 810) comprises at least one artificial hollow fiber (900).

Example 22

Method for manufacturing an article of sports apparel, the method comprising the steps of:

a. providing at least one base portion;

b. providing at least one elongate support element;

c. pressing the at least one elongate support element on the at least one base portion at a temperature in the range of 100° C. and 180° C., in some embodiments, in the range of 125° C. and 140° C. or 160° C. to 180° C.

Example 23

Method according to Example 22, wherein a pressure of 2 bar to 6 bar, in some embodiments, 2.8 bar to 4.1 bar, is applied.

Example 24

Method according to Example 22 or 23, wherein the step of pressing is carried out for a duration of 15 seconds to 40 seconds, in some embodiments, 20 seconds to 30 seconds.

Example 25

Method according to any of Examples 22-24, wherein the at least one elongate support element is provided having at least two layers.

Example 26

Method according to any of Examples 22-25, wherein the elongate support element comprises a low activation temperature adhesive, particularly an adhesive activatable at a temperature in the range from 80° C. to 150° C., from 100° C. to 140° C., or from 120° C. to 130° C.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. An article of sports apparel comprising:

at least one base portion adapted to be arranged proximate a lower back of a user when worn;

at least two elongate support elements, wherein:

the at least two elongate support elements are attached to the at least one base portion to extend outwardly from a region at least partially encompassing the lower back of the user when worn;

at least one of the at least two elongate support elements is arranged to cross over a spine of the user when worn; and an elastic modulus of at least one of the elongate support elements is lower in a direction along the elongate support element compared to a direction orthogonal to the elongate support element.

2. The article of sports apparel of claim 1, wherein at least one of the at least two elongate support elements is arranged to form an angle with the spine in a range from 30° to 80°.

3. The article of sports apparel of claim 1, wherein at least one of the at least two elongate support elements is arranged to form an angle with the spine in a range from 50° to 71°.

4. The article of sports apparel of claim 1, wherein the region is between a lower end of a sacrum of the user and an upper end of a next-to-lowest lumbar vertebra of the user.

5. The article of sports apparel of claim 1, wherein at least one of the at least two elongate support elements comprises a layer on at least one of an inside and an outside of the at least one base portion.

6. The article of sports apparel of claim 1, wherein at least one of the at least two elongate support elements is at least partly arranged at an inner and/or an outer surface of the at least one base portion at a seam of the at least one base portion.

7. The article of sports apparel of claim 1, wherein at least one of the at least two elongate support elements comprises a thickness between 0.3 mm and 0.8 mm.

8. The article of sports apparel of claim 1, wherein at least one of the at least two elongate support elements comprises a thermoplastic elastomer.

9. The article of sports apparel of claim 1, wherein at least one of the at least two elongate support elements comprises a polyurethane.

10. The article of sports apparel of claim 1, wherein at least one of the at least two elongate support elements comprises a fabric.

11. The article of sports apparel of claim 1, wherein at least one of the at least two elongate support elements is attached to the at least one base portion by a discontinuous adhesive.

12. The article of sports apparel of claim 1, wherein at least one of the at least two elongate support elements has a higher elastic modulus than the at least one base portion.

13. The article of sports apparel of claim 1, wherein at least one of the at least two elongate support elements extends at least partly around a lateral torso region of the article of sports apparel.

14. The article of sports apparel of claim 13, wherein at least two of the at least two elongate support elements intersect each other in a breast region of the article of sports apparel.

15. The article of sports apparel of claim 1, wherein:

at least one of the at least two elongate support elements extends at least partly around a lateral pelvis region of the article of sports apparel; and at least one of the at least two elongate support elements extends at least partly around a lateral thorax region of the article of sports apparel.

16. The article of sports apparel of claim 1, wherein at least one of the at least two elongate support elements extends at least partly around a shoulder region of the article of sports apparel.

17. The article of sports apparel of claim 1, wherein at least one of the at least two elongate support elements circumscribes a leg region of the article of sports apparel.

18. The article of sports apparel of claim 1, wherein at least one of the at least two elongate support elements extends in at least one of a front region and a back region of a thigh region of the article of sports apparel.

19. The article of sports apparel of claim 1, wherein at least one of the at least two elongate support elements extends in a groin region of the article of sports apparel.

20. The article of sports apparel of claim 1, further comprising a profile element arranged on the at least one base portion in the region at least partially encompassing the lower back of the user when worn.

21. The article of sports apparel of claim 1, wherein the at least one base portion comprises at least one artificial hollow fiber.

22. A method for manufacturing an article of sports apparel, the method comprising:

providing at least one base portion;

providing at least one elongate support element; and pressing the at least one elongate support element on the at least one base portion at a temperature in a range of 100° C. and 180° C., wherein:

the at least one elongate support element is arranged to cross over a spine of a user when worn; and at least a portion of the base portion comprises an artificial hollow fiber.

23. The method of claim 22, further comprising applying a pressure of 2.8 bar to 4.1 bar.

24. The method of claim 22, wherein the pressing occurs for a duration of 20 seconds to 30 seconds.

25. The method of claim 22, wherein the at least one elongate support element comprises at least two layers.

26. The method of claim 22, wherein the at least one elongate support element comprises a low activation temperature adhesive activatable at a temperature in a range from 80° C. to 150° C.

27. An article of sports apparel comprising:

at least one base portion adapted to be arranged proximate a lower back of a user when worn, wherein the at least one base portion comprises an elastic material, the at least one base portion comprising an inner surface and an outer surface;

a plurality of elongate support elements that are disposed on at least one of the inner surface and the outer surface, wherein at least one of the plurality of elongate support elements comprises an elastic material having a different elastic modulus than the at least one base portion; and wherein at least two of the plurality of elongate support elements (i) cross one another in a region at least partially encompassing the lower back of the user when worn and (ii) extend outwardly from the region at least partially encompassing the lower back of the user when worn.

28. The article of sports apparel of claim 1, wherein the at least one base portion is elastic.

* * * * *